US007226041B2

(12) United States Patent
Ledford

(10) Patent No.: US 7,226,041 B2
(45) Date of Patent: Jun. 5, 2007

(54) WINCH ASSEMBLY FOR A LIFT STRUCTURE SUPPORTIVE OF A RECREATIONAL BOAT AND RELATED WATERCRAFT

(76) Inventor: Michael Paul Ledford, 13174 Venture La., Crosslake, MN (US) 56442

( * ) Notice: Subject to any disclaimer, the term of this patent is extended or adjusted under 35 U.S.C. 154(b) by 50 days.

(21) Appl. No.: 11/241,503

(22) Filed: Oct. 1, 2005

(65) Prior Publication Data

US 2006/0169961 A1 Aug. 3, 2006

Related U.S. Application Data

(60) Provisional application No. 60/615,454, filed on Oct. 2, 2004.

(51) Int. Cl.
*B66D 1/22* (2006.01)

(52) U.S. Cl. ..... 254/342; 254/358; 405/3; 114/44; 414/678

(58) Field of Classification Search ..... 254/342, 254/356, 358, 362; 114/44, 48, 51; 405/3; 414/678
See application file for complete search history.

(56) References Cited

U.S. PATENT DOCUMENTS 3,782,692 A * 1/1974 Casco et al. ..... 242/387
3,784,165 A 1/1974 Pruitt
4,623,038 A 11/1986 Stancato
4,686,863 A 8/1987 Inoue et al.
4,763,592 A 8/1988 Russ
5,295,664 A * 3/1994 Kamper ..... 254/220
5,345,834 A 9/1994 Hayashi
5,628,583 A 5/1997 Gibson
5,970,813 A 10/1999 Parkins et al.
6,033,148 A 3/2000 Norfolk et al.
6,397,691 B1 6/2002 Greene
6,435,768 B1 8/2002 Mansfield
2006/0196401 A1* 9/2006 Masters ..... 114/44

* cited by examiner

*Primary Examiner*—Emmanuel M Marcelo
(74) *Attorney, Agent, or Firm*—Michael A. Mochinski

(57) ABSTRACT

An improved winch assembly adaptably configured for use with a new or existing lift structure suitably dedicated for short- and long-term storage of a recreational boat and related watercraft. The winch assembly comprises three drive assemblies housed and mounted within a chassis. The first drive assembly comprises a first plate sprocket and a pair of cable guards collectively mounted onto a cable hub to form a spool assembly for accepting and winding thereon a predetermined length of cabling. The second drive assembly comprises a stepped hub having three discrete cylindrical surfaces to form first and second annular walls for mounting thereagainst primary and secondary plate sprockets and an inner bore extending therethrough for receiving therein an intermediate axle having ends affixed to the chassis, wherein the primary plate sprocket is connectively coupled with the first plate sprocket by a drive chain. The third drive assembly comprises a motor hub mounted to the chassis by means of a mount plate and having primary and secondary cylindrical surfaces each of differing diameter to form an annular wall for mounting thereagainst a plate sprocket connectively coupled to the secondary plate sprocket by a motor drive chain and first and second elongate bores extending longitudinally through the primary and secondary cylindrical surfaces for receiving and housing therein an output shaft of either a 110/220- or 12/24-volt electric motor and an axle having a hex-shaped head positioned externally to the mount plate for manual turning of the drive assemblies in the event of the electric motor's failure, respectively.

38 Claims, 22 Drawing Sheets

WINCH ASSEMBLY FOR A LIFT STRUCTURE SUPPORTIVE OF A RECREATIONAL BOAT AND RELATED WATERCRAFT

CROSS-REFERENCE TO RELATED APPLICATIONS

This application claims the benefit of priority from U.S. Provisional Application Ser. No. 60/615,454 filed Oct. 2, 2004, entitled "Improved Winch Assembly for a Lift Structure Supportive of a Recreational Boat and Related Watercraft," the disclosures of which, including all attached documents, are incorporated herein by reference in their entirety for all purposes.

FIELD OF THE INVENTION

The present invention relates to an improved winch assembly adaptably configured for use with new and existing lift structures suitably dedicated for short- and long-term storage of a recreational boat and related watercraft. More particularly, the present invention relates to an improved winch assembly comprising automated means for lowering and raising the recreational boat to and from the water's surface insofar to facilitate the docking and undocking of the boat by a single user.

BACKGROUND OF THE INVENTION

The prior art describes a variety of boat lift devices. A typical boat lift device may be fabricated from an aluminum alloy to guard against premature corrosion while being situated in shallow water near the shore of a body of water such as a lake. The boat lift's entire structure generally rests on the floor of the lake and is made accessible by a floating or anchored dock extending from the shoreline to the boat lift. Boats are driven onto a boat lift in a similar manner a car is driven into a garage stall, with exception that a boat lift comprises structural means for guiding the boat during the events of loading and unloading; the typical boat lift may comprise a hull support platform having a v-shaped configuration to adequately support and laterally stabilize the boat while being stationed on the boat lift.

Recreational boat lifts have two primary positions: up or down. In the down position, the hull support platform is submerged below the surface of the water as well as a portion of its supporting structure. To reach the up position to the extent of lifting and supporting the boat from and above the water's surface, the hull support platform must travel angularly forward until it is in alignment with and positioned perpendicular to a plurality of main vertical supports or until each of the hull support rails exist above the water's surface. Boat lifts typically known in the art can lift and support a recreational boat weighing as much as 8,000 pounds. To accomplish the task of raising and lowering a boat at any given weight limit without undue effort, the art offers mechanical means comprising a cranking wheel of modest diameter located alongside the boat lift generally in vicinity of the dock. In most instances of its use, the cranking wheel is connected to a train of gears selectively arranged to achieve a desirable gear ratio that would allow an individual to lift a moderately weighted boat by applying a small amount of force, but necessitating rotational movement of the cranking wheel over an extended circumferential distance. In this regard, the lifting of the boat may take upwards to 7 to 10 minutes, generally requiring an individual to turn the large cranking wheel approximately 150 revolutions.

In addition to the means available to lift and lower a boat from and to the water's surface, as discussed herein, the boat lift as well as the dock may comprise a structure designed to protect and cover a boat. Sun fading, bird droppings and rain can all damage or make the interior of the boat uncomfortable for use. Like the protective structure, the boat lift provides added means for protecting the boat during episodes of high winds or unfavorable climatic conditions. Lifting a boat out of the water through effective means mitigates any occurrence of overturning and sinking of the boat or repetitive crashing of the boat into the floating or anchored dock connected to the shoreline. Since storms can and do approach suddenly, the manual process of lifting a boat can be slow and even dangerous in the face of a fast approaching storm.

Accordingly, there remains a need for device which allows a single boat operator to effectively lift and lower the boat without undue hardship and within tolerable time limits, particularly in the event of a sudden weather change which may be occasionally encountered during a boat outing.

BRIEF SUMMARY OF THE INVENTION

In order to overcome the numerous drawbacks apparent in the prior art, an improved winch assembly comprising automated means has been devised for use with new and existing boat lift structures of the type commonly known in the art to include manual lifting and lowering means, such as a large diameter wheel connectively attached to a gearing arrangement that selectively supports a desirable gear ratio for ease of operation.

It is thus an object of the present invention to provide a reliable, easily operated winch assembly capable of being operated onshore or offshore to further a single user's desire to engage in the sport of boating alone or with other individuals not necessarily having the muscular capacity to operate a manually operated boat lift.

It is another object of the present invention to provide such a winch assembly which mitigates exposure to moving parts most near the dock area where occupants gather for loading onto and unloading from a recreational boat.

It is another object of the present invention to provide such a winch assembly which allows an operator to raise a boat from the water's surface in short fashion to further protect the boat from physical damage caused by imminent storms, sustained wave actions, tides, and so forth.

It is another object of the present invention to provide such a winch assembly comprising ready means for accessing a drive assembly purposefully to engage in general maintenance and repair.

It is another object of the present invention to provide such a winch assembly which readily permits alteration of gear ratios to suitably and more accurate correspond with the weight of the boat.

It is another object of the present invention to provide such a winch assembly comprising means for operation from a self contained energy source or a standard 110/220 volt wired energy source.

It is yet another object of the present invention to provide such a winch assembly which accomplishes the foregoing and other objects and advantages and which is economical, durable, and fully effective in performing its intended functions.

In accordance with the present invention, an improved winch assembly has been devised for use with a new or existing lift structure supportive of a recreational boat and related watercraft, the assembly comprising in combination three drive assemblies housed within and mounted to a chassis; the first drive assembly comprising a first plate sprocket and a pair of cable guards collectively mounted onto a cable hub to form a spool assembly for accepting and winding thereon a predetermined length of cabling having one end attached to a platform portion of the lift structure and a second end fixedly attached to a cabling barrel; the second drive assembly comprising a stepped hub having three discrete cylindrical surfaces to form first and second annular walls suitably serving as reinforcing means for mounting primary and secondary plate sprockets thereto and an inner bore extending therethrough for receiving therein an intermediate axle having ends affixed to the chassis, wherein the primary plate sprocket is connectively coupled with the first plate sprocket by a drive chain; the third drive assembly comprising a motor hub suitably mounted to the chassis by a mount plate and having primary and secondary cylindrical surfaces each of differing diameter to form an annular wall for mounting thereagainst a plate sprocket configurably coupled to the secondary plate sprocket by a motor drive chain and first and second elongate bores extending longitudinally through the primary and secondary cylindrical surfaces for receiving therein a portion of an output shaft of either a 110/220- or 12/24-volt electric motor and an axle having a hex-shaped head positioned externally to the mount plate for manual turning of the drive assemblies in the event of inoperable conditions of the electric motor, respectively; and either a 110/220- or 12/24-volt electrical circuit suitably mounted on a board each having a brake effects delay sub-circuit electrically coupled to the electric motor and configurably arranged to cooperate with the electronic braking features of the electric motor to safely and adequately suspend and hold the weight of the recreational boat situated on the platform portion of the lift structure and a switching sub-circuit and remote control sub-circuit for local and distant operation of the electric motor to suitably set in motion the drive assemblies in directional modes of forward and reverse to raise and lower the platform, respectively.

Other objects, features, and advantages of the present invention will become apparent in the following detailed description of the preferred embodiments thereof when read in conjunction with the accompanying drawings in which like reference numerals depict the same parts in the various views.

BRIEF DESCRIPTION OF THE SEVERAL VIEWS OF THE DRAWINGS

A preferred embodiment of the present invention will now be described by way of example with reference to the accompanying drawings, in which.

DETAILED DESCRIPTION OF THE PREFERRED EMBODIMENT

While this invention is susceptible of being embodied in many different forms, the preferred embodiment of the invention is illustrated in the accompanying drawings and described in detail hereinafter with the understanding that the present disclosure is to be considered to exemplify the principles of the present invention and is not intended to limit the invention to the embodiments illustrated and presented herein. The present invention has particular utility as a device for use with new and existing boat lift structures, particularly serving as automated means for lowering and lifting a recreational boat to and from the water's surface by a single operator.

Figure 1:
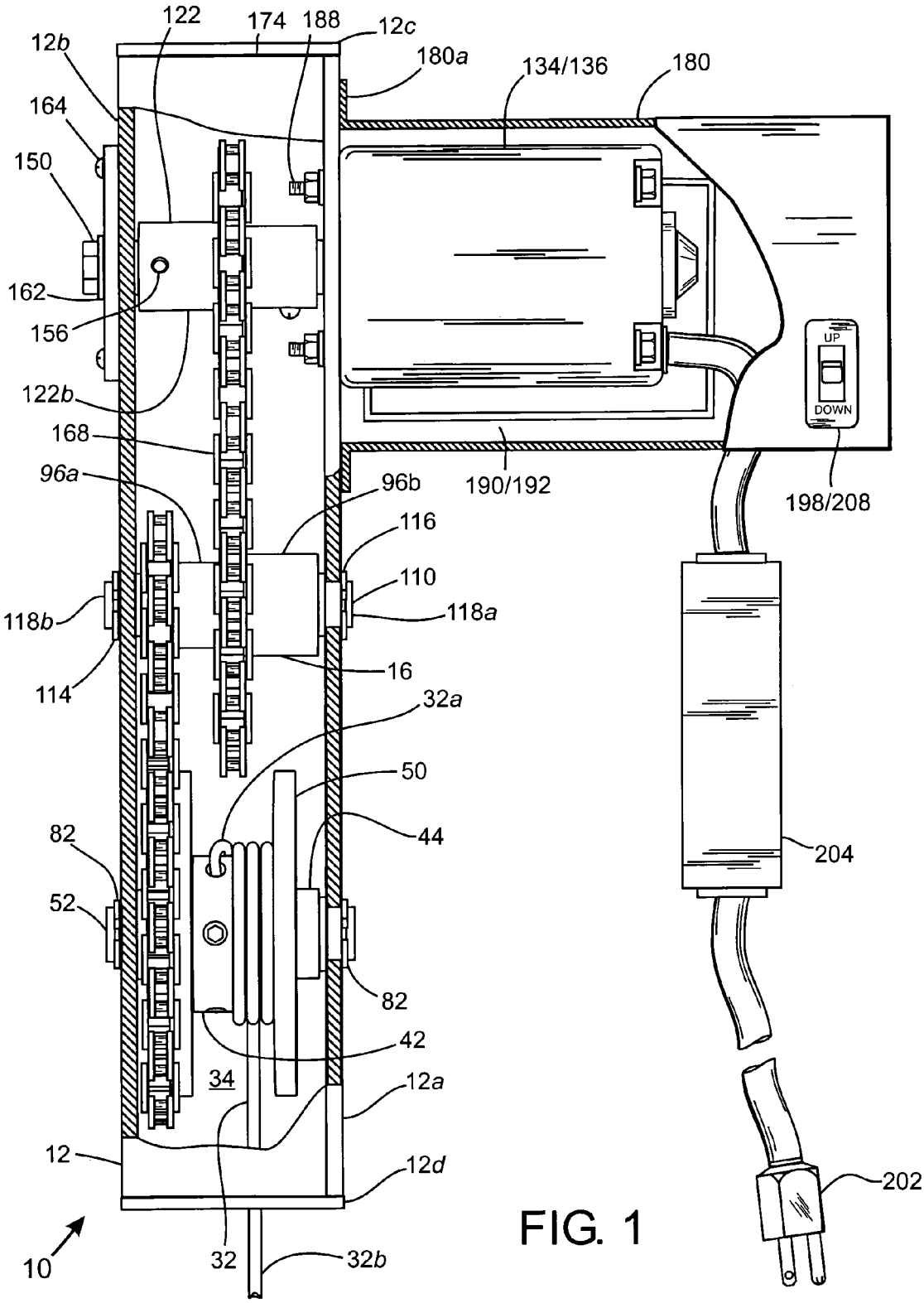
FIG. 1 is a side cross sectional view of the preferred embodiment of the present invention illustrating three drive assemblies housed within a chassis and an electric motor and an electrical circuit board collectively protected by a motor/electrical cover externally mounted on the chassis.
Figure 2:
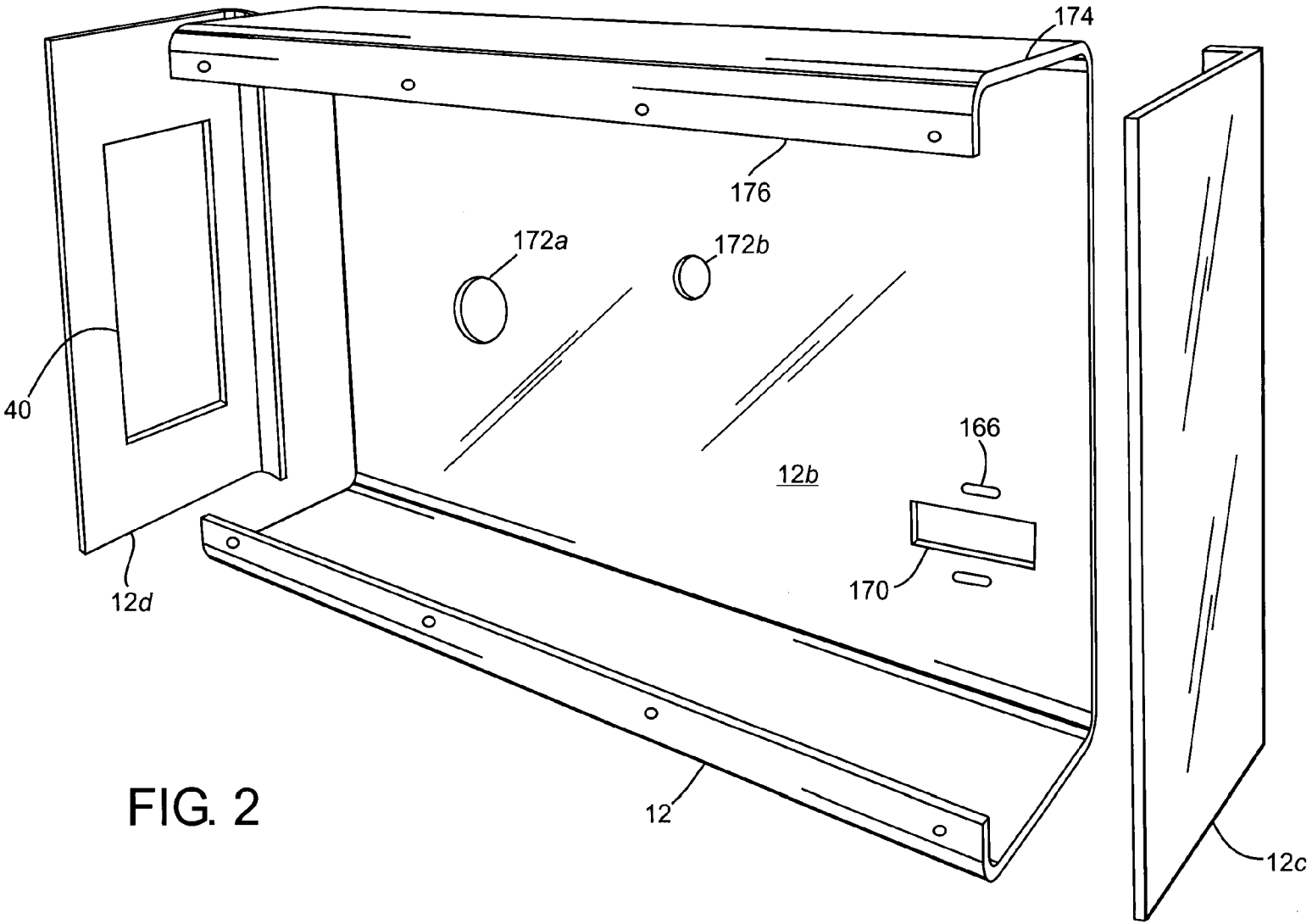
FIG. 2 is a perspective view of the present invention illustrating a chassis comprising a back mount plate integrally attached to a pair of integral sides and top and bottom sides apart therefrom.
Figure 3:
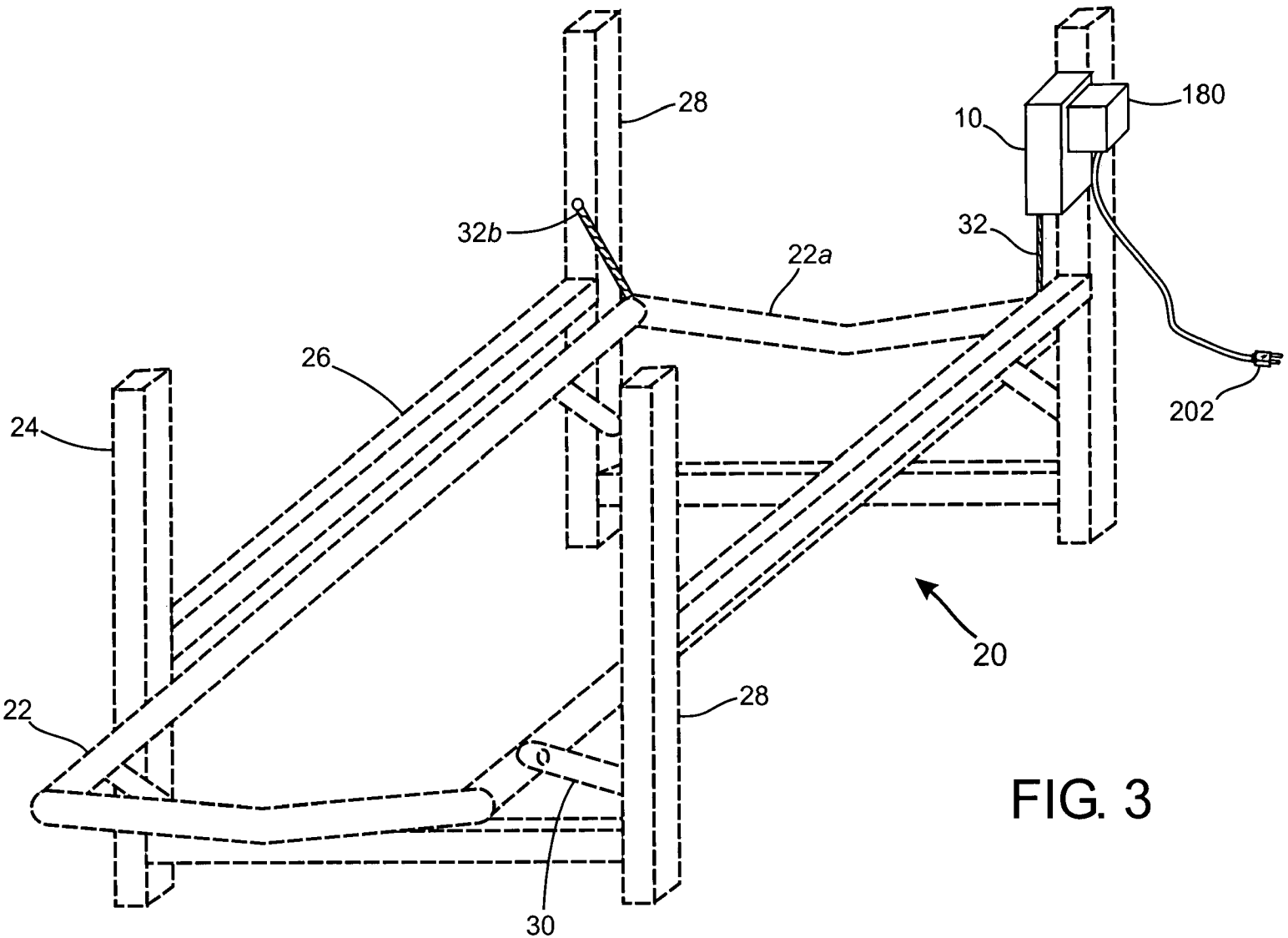
FIG. 3 is a perspective view of the present invention illustrating the preferred positioning thereof on a boat lift structure.

Referring now to FIGS. 1 and 2, there is shown generally at 10 a winch assembly comprising a chassis 12 having front access and back mount plates 12*a*, 12*b* and top and bottom sides 12*c*, 12*d* collectively configured to mount and house therein three drive assemblies 14, 16, 18 each having one or more plate sprockets fixedly attached thereto to achieve an overall, tolerable gear ratio for lifting and lowering a boat of modest weight. It is noted herein that the present invention is most suitable for use in lifting and lowering a recreational boat weighing in the range of 2,000 to 8,000 pounds, comparably falling within the weight classification of boat lifts known in the art to support such loads. However, the present invention is not necessarily limited by this weight classification and may be appropriately configured (e.g., re-alteration of gear ratios) to function with a lift structure most notably useful with a personal watercraft weighing substantially less than a recreational boat, such as a jet ski commonly referred to and known in the art to carry one to two persons. It is further noted herein that the present invention is preferably used in conjunction with a boat lift structure 20 typically known in the art to comprise a platform 22 substantially conforming to the geometric shape of the boat's hull and configurably situated within and supported by a frame structure 24 comprising a plurality of horizontal and vertical support members 26, 28, wherein the platform is pivotally fastened to the vertical members by means of an equal number of angular-moving braces 30. Upward and downward travel of the platform is principally established by a cable network 32 extending from a cranking wheel selectively displaced by the present invention and terminating at one of the vertical support members 28, substantially in the manner shown in FIG. 3. Although not illustrated herein, a series of pulleys serve as means for guiding the cable 32 in and through a tubular portion 22*a* of the platform to eliminate binding of the cable network as the platform is raised and lowered above and below the water's surface, respectfully. As will be discussed hereinafter in further detail, the present invention is preferably mounted to one of the vertical support members 28, generally at the displaced location of the cranking wheel, and utilizes the existing cable network 32 integrally in use with the boat lift structure 20. It is noted herein, however, that the lift structure depicted above is merely descriptive of an embodiment thereof, and is presented herein to illustrate a typical application of the present invention without necessarily limiting the use of the present invention with other lift structures known in the art.

Figure 4:
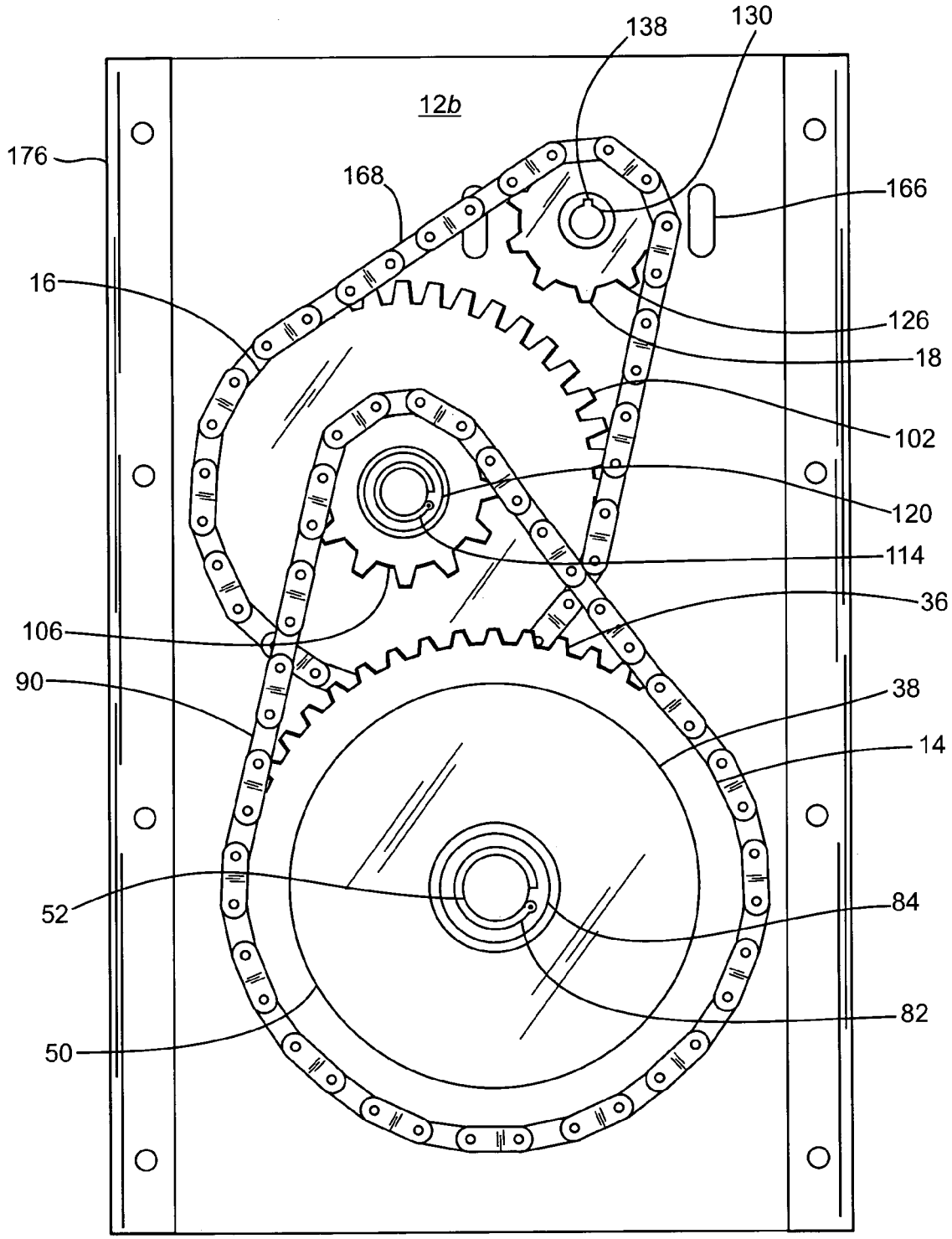
FIG. 4 is a front view of the present invention illustrating drive assemblies exposed within a chassis.
Figure 5:
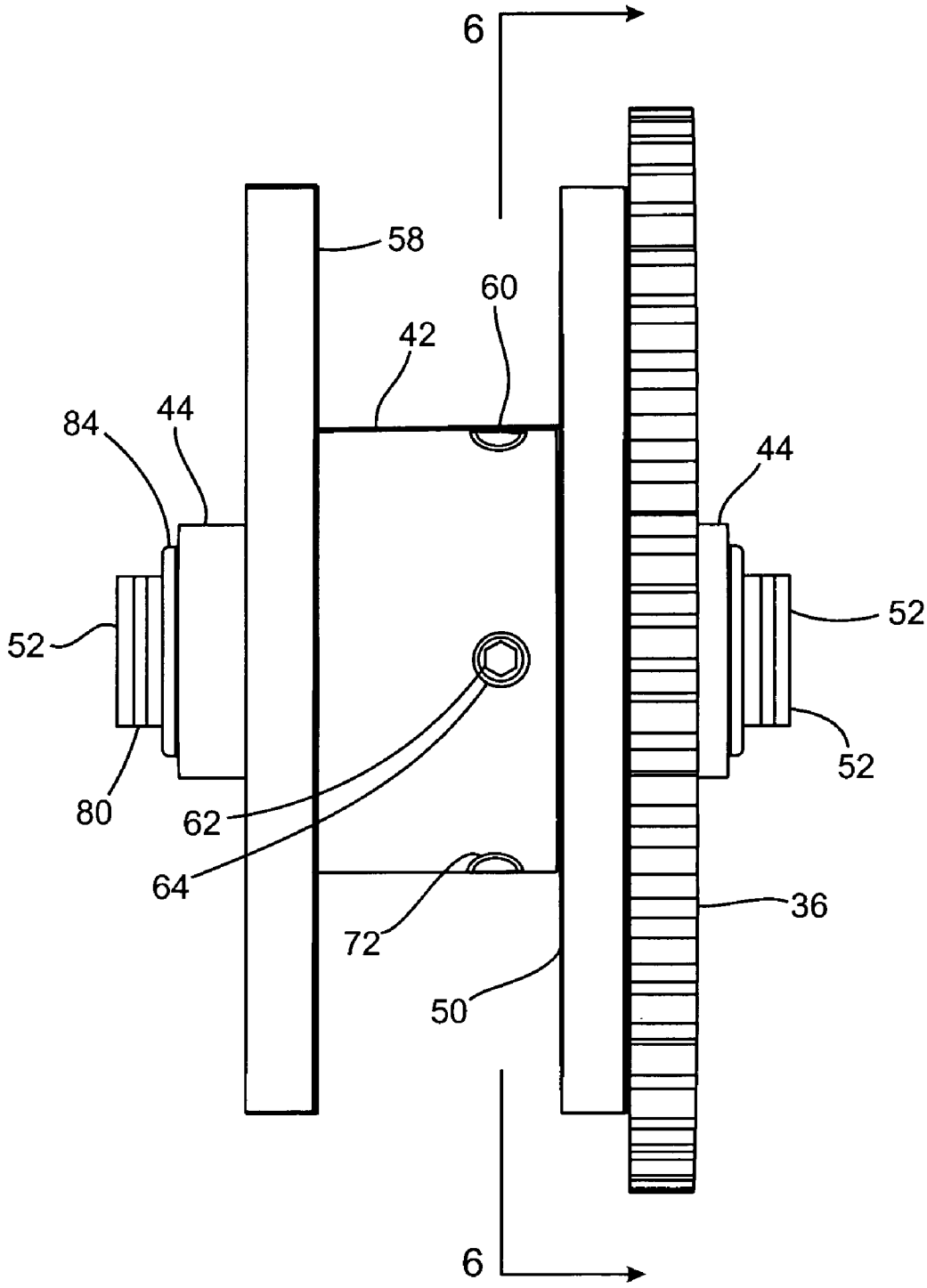
FIG. 5 is a side view of the present invention illustrating a first drive assembly comprising a spool assembly and a first plate sprocket collectively mounted on a cable hub.
Figure 6:
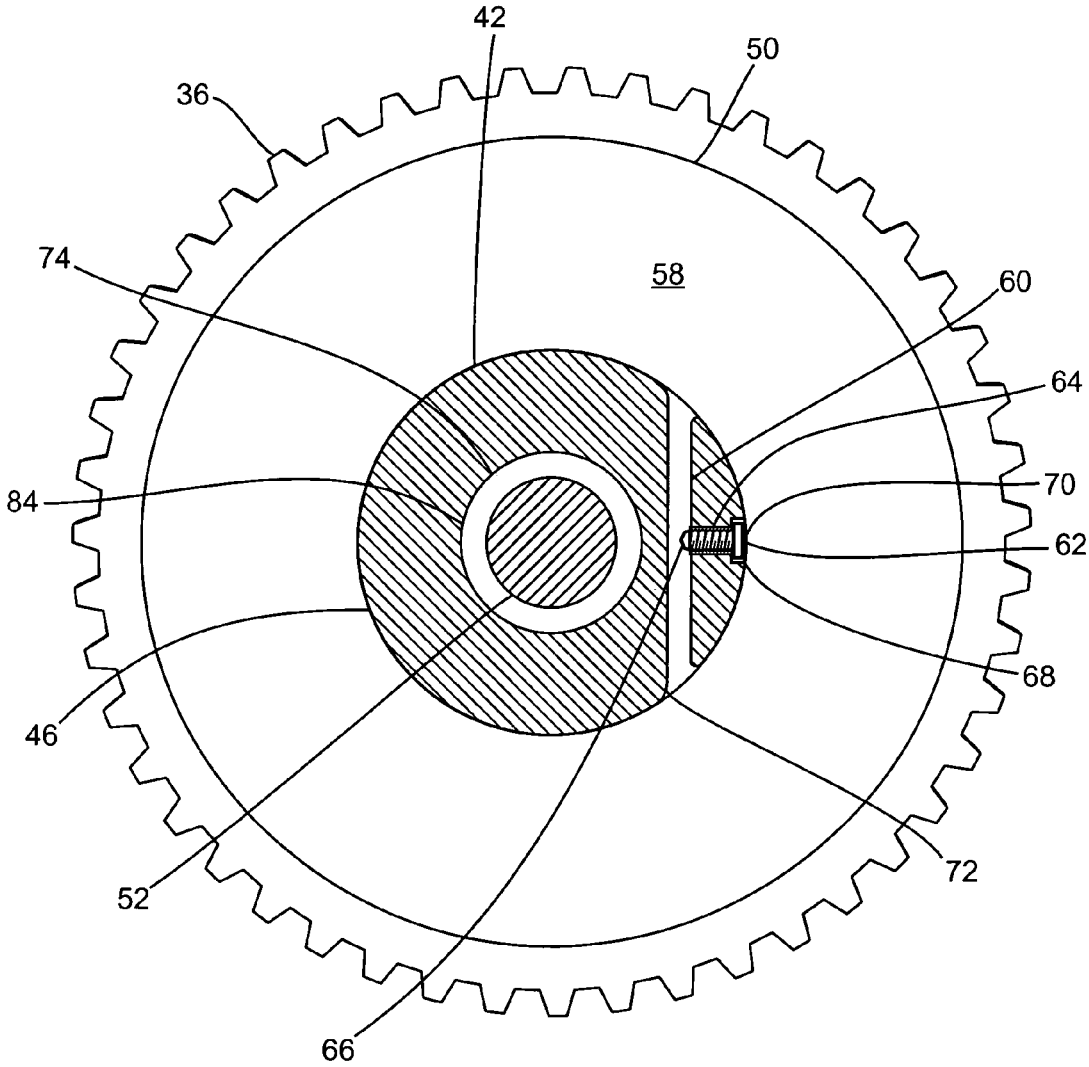
FIG. 6 is a side cross sectional view of the preferred embodiment of the present invention taken on line 6—6 of FIG. 5 illustrating a spool assembly and a first plate sprocket collectively mounted on a cable hub.
Figure 7:
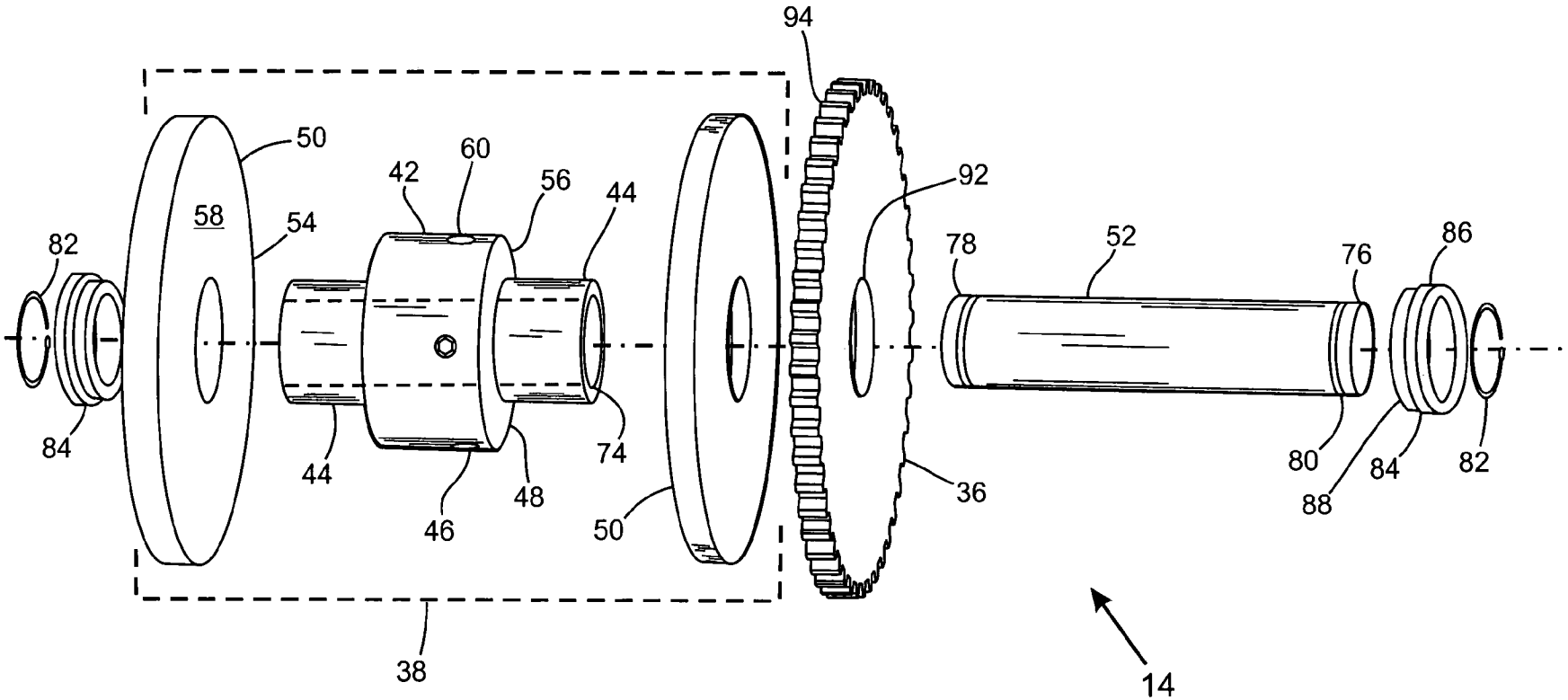
FIG. 7 is a disassembled, side perspective view of the present invention illustrating a first drive assembly comprising a spool assembly, a first plate sprocket, and a cable shaft.

As illustrated in FIG. 4, a first drive assembly 14 is mounted within a bottom portion 34 of the chassis 12 and comprises a first plate sprocket 36 which concurrently drives a spool assembly 38 for winding a predetermined amount of cabling 32 having one end 32*a* attached thereto and a second end 32*b* passing through an opening 40 of the bottom side 12*d* of the chassis and terminating at an adjacent vertical support member 28, as hereinbefore discussed. The spool assembly initially comprises a cabling barrel 42 situated in between a pair of outwardly extending supports 44 of cylindrical form collectively forming a cable hub 46 substantially in the manner shown in FIGS. 5 and 6. To strengthen the cable hub to the extent of tolerating radial and axial forces acting thereon during episodes of lifting and lowering, the cable hub is machined from a unified piece of carbon steel. Regardless of the preferred methodology of construction, the cabling barrel 42 comprises a larger diameter than each of the outwardly extending supports, preferably by a factor of 2:1, to form adjoining surface area 48 for attaching thereto a pair of cable guards 50 to complete the assembly of the spool assembly. The collective arrangement of the cable guards serve to mitigate inadvertent winding of the cabling 32 beyond the designated area of the spool assembly 38 and limit the extent of unfavorable interaction and entanglement with the first plate sprocket 36 as each rotatably moves in unison about a cable shaft 52. Each cable guard, as depicted in FIG. 7, comprises a disk-like shape and an aperture 54 extending therethrough at its center to accept and house a portion of the outwardly extending support 44. In assembled form, each outwardly extending support is slidably fitted into the aperture of the cable guards and movably positioned to abut up against a shoulder 56 formed by the diametric difference of the cabling barrel and outwardly extending support, as noted hereinbefore. Fastening of each cable guard 50 to the cable hub to form complete assembly of the spool assembly is performed by welding along the seam formed in between the circumference of the cabling barrel 42 and inner planer surface 58 of each of the cable guards abutting and engaging the shoulder 56. To maintain secure positioning or prevent inadvertent release of the cabling 32 from the spool assembly 38, one end of the cabling is fitted into an offset bore 60 traversing the cabling barrel and held tighteningly therewithin by a set screw 62 threadably placed within a threaded bore 64 extending perpendicular to the offset bore, substantially as depicted in FIG. 6. Preferably, the set screw comprises a tapered end 66 to permit penetrating engagement with that of the cabling to fully secure its position within the offset bore. In order to permit the set screw to set flush with the surface of the cabling barrel 42, primarily to mitigate inadvertent interaction of the set screw with that of the cabling as it is wound about the cabling barrel, the threaded bore 64 comprises a recessed opening 68 to accept therein an end portion 70 of the set screw which comprises a hex head to facilitate tightening and loosening of the set screw. In a typical application, the cabling barrel is sufficiently wound with a predetermined length of cabling 32, preferably a length equating to eight times the circumference thereof to supplement secure positioning and ensure the cabling is fully intact with the spool assembly notwithstanding the relative positioning of the boat lift's platform. In other words, there remains a sufficient amount of cabling wound onto the cabling barrel 42 even after positioning the boat lift's platform 22 to its lowermost position, below the water's surface. To alleviate fraying or breakage of the cabling end as a result of being bent and placed inwardly into the offset bore 60, each end of the bore comprises a beveled or chambered edge 72 to provide a smooth transition as the cabling 32 is wrapped and wound about the outer circumferential surface of the cabling barrel. As illustrated in FIG. 7, the cable hub 46 further comprises an axial bore 74 extending lengthwise thereof for receiving therethrough and housing a portion of the cable shaft having a solid cylindrical shape and first and second ends 76, 78. Each end of the cable shaft is fitted with an annular groove 80 of the type to receive an open-ended retaining clip 82 to retain axial positioning of the cable axle while being housed and situated within the chassis 12. Fitting the retainer clip onto the cable shaft 52 is primarily accomplished by spreading open a portion of the retaining clip until it suitably corresponds to the diameter of the cable shaft less the depth of the annular groove. Once the open portion of the retaining clip comprises this dimensional relationship, the retaining clip 82 is slidably positioned within and fitted into the annular groove and momentarily released for secure positioning threat. In order to allow the spool assembly 38 to rotate freely about the cable shaft, particularly while the cable shaft ends are fixedly mounted to the access and back mount plates 12*a*, 12*b* of the chassis 12, as shown in FIG. 1, each end of the axial bore as well as the cable shaft share a press-fitted flange bearing 84 having primary and secondary outer surfaces 86, 88, specifically of the type commonly available and known in the art for such applications. In preferred applications, each flange bearing is positioned in such a manner that the primary outer surface 86 exists outside the opening of the axial bore 74 by a distance of at least ⅛" while the secondary outer surface 88 is housed within the axial bore of the cable axle, particularly in the manner shown in FIG. 5. The resultant extension of the flange bearing 84 along the cable shaft and beyond the outwardly extending support 44 ensures a tolerable clearance between each end of the outwardly extending supports and front access and back mount plates 12*a*, 12*b* of the chassis 12 insofar to permit rotation of the spool assembly 38 within the chassis structure without undue rotatable hindrance. As shown in FIG. 1, the first plate sprocket 36 preferably comprises a 47-tooth configuration with each tooth preferably having a pitch of 9° to accept a drive chain 90 of comparable configuration and an aperture 92 extending through its center. Mounting of the first plate sprocket near and to the spool assembly is substantially achieved by slidably fitting one of the outwardly extending supports 44 through the aperture and positioning the first plate sprocket 36 up against one of the two cable guards; welding along a seam formed along the perimeter of one of the cable guards 50 and inner face 94 of the first plate sprocket substantially serves to station the first plate sprocket thereabout for unison operation with the spool assembly 38.

Figure 8:
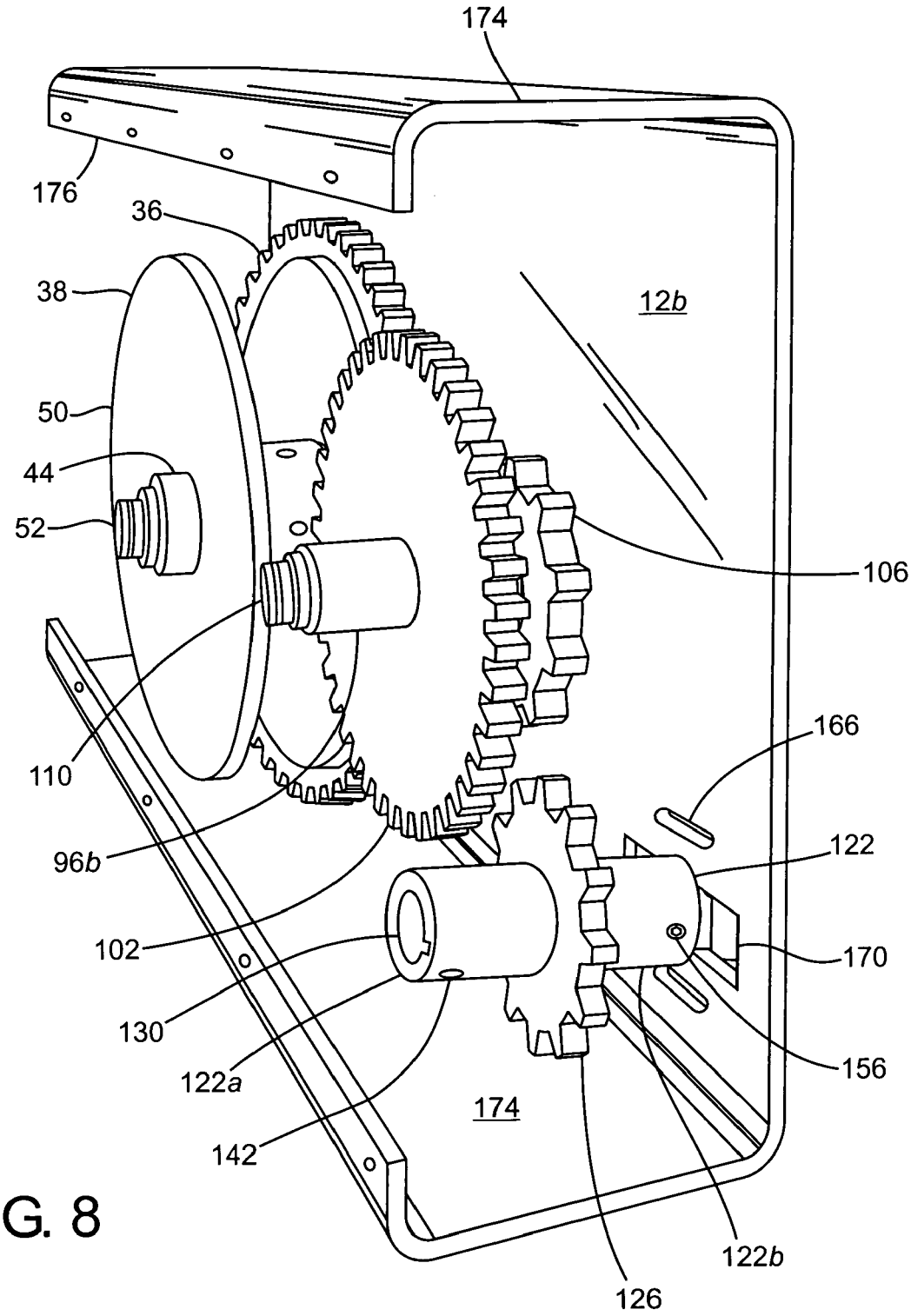
FIG. 8 is a perspective view of the present invention illustrating three drive assemblies mounted to a back mount plate of a chassis.
Figure 9:
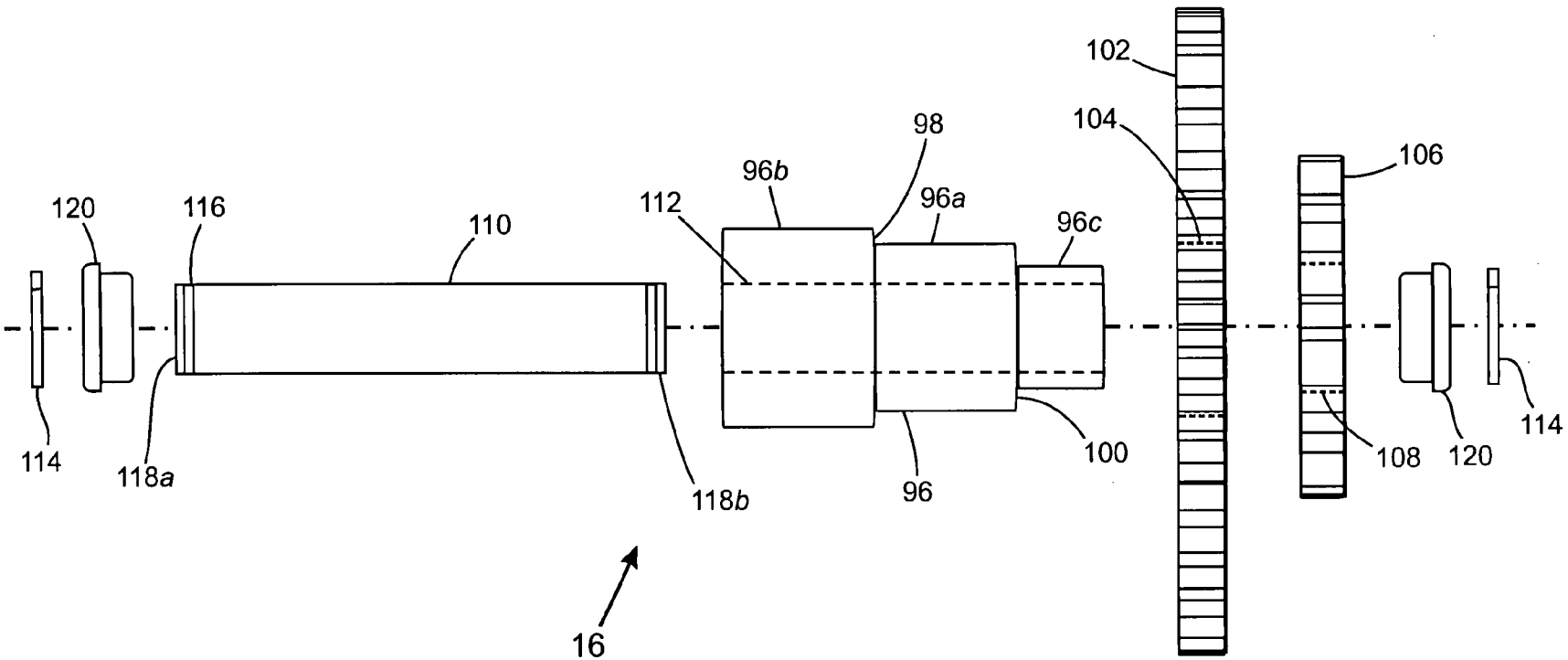
FIG. 9 is a disassembled, side view of the present invention illustrating a second drive assembly comprising a stepped hub, primary and secondary plate sprockets, and an intermediate axle having ends fitted with an annular groove.
Figure 10:
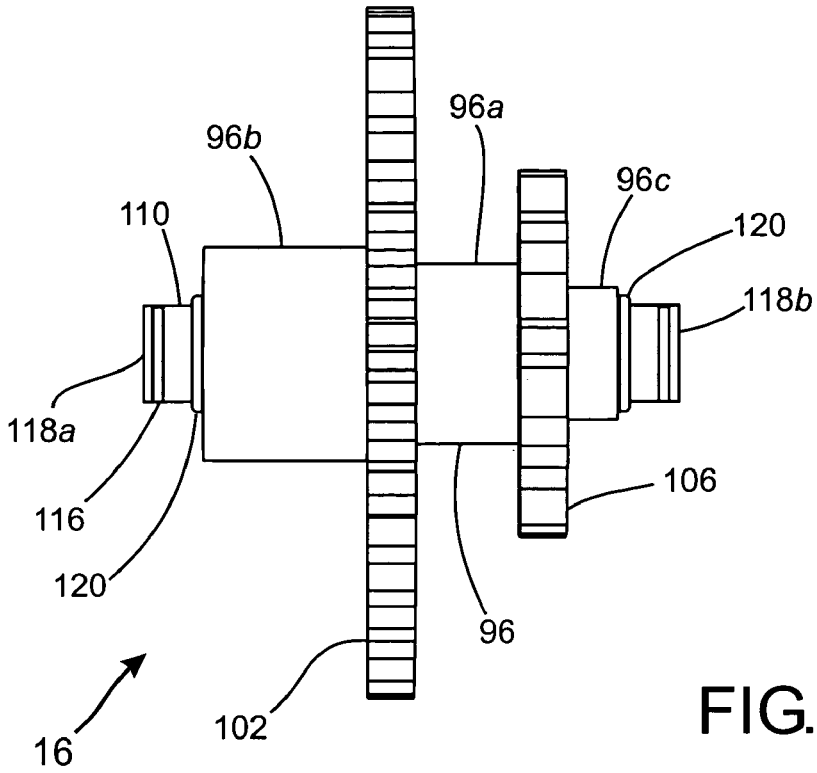
FIG. 10 is a side view of the present invention illustrating a second drive assembly comprising primary and secondary plate sprockets mounted on a stepped hub having three discrete cylindrical surfaces.
Figure 11:
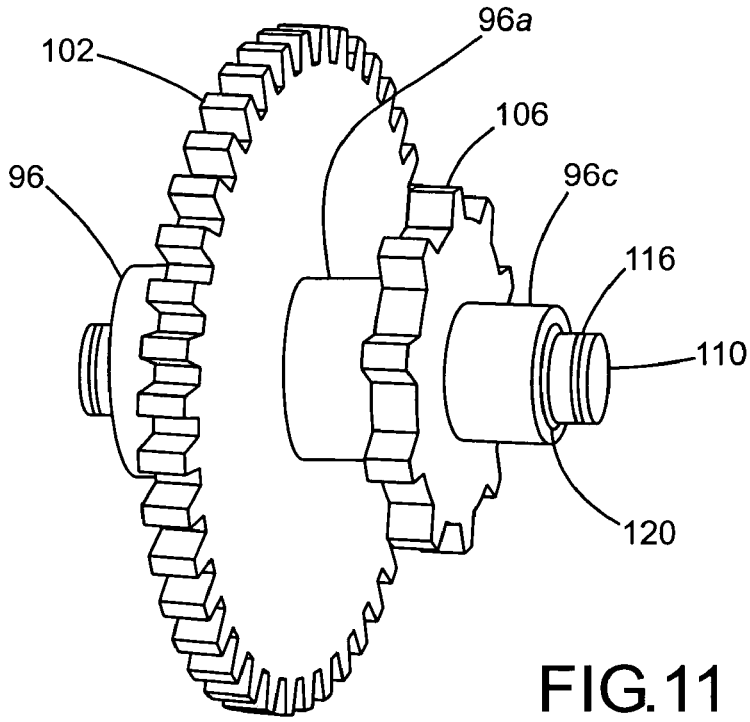
FIG. 11 is a perspective view of the present invention illustrating a second drive assembly comprising primary and secondary plate sprockets mounted on a stepped hub having three discrete cylindrical surfaces.

Referring now to FIG. 8, a second drive assembly 16 is mounted intermediate the first and third drive assemblies and assists in providing a net gear reduction ranging from 18:1 to 24:1, which is substantially based on a ½ to ¾ hp motor driving the third drive assembly 18, respectively. The second drive assembly, as illustrated in FIG. 9, comprises a stepped hub 96 of integral construction having three discrete cylindrical surfaces 96*a*, 96*b*, 96*c* each of a predetermined diameter to form first and second annular walls 98, 100. A primary plate sprocket 102 having a 40-tooth configuration and an aperture 104 extending through its center is slidably fitted onto the first cylindrical surface 96*a* and inwardly positioned until it abuts and engages the first annular wall 98 as principally established by the diametric difference of the first and second cylindrical surfaces 96*a*, 96*b*. Similarly, a secondary plate sprocket 106 having a 10-tooth configuration and an aperture 108 extending through its center is slidably fitted onto the third cylindrical surface 96*c* and inwardly positioned until it abuts and engages the second annular wall 100 as principally established by the diametric difference of the first and third cylindrical surfaces 96*a*, 96*c*. In assembled form, the primary and secondary plate sprockets substantially bound the first surface 96*a* at its ends, as shown in FIGS. 10 and 11, and are fixedly attached to the stepped hub 96 by placement of a bead of weld along the circumferential portion of each of the apertures of the primary and secondary plate sprockets as well as along a seam formed in between the abutting arrangement of the primary and secondary plate sprockets and first and second annular walls, respectfully. As depicted in FIG. 4, the first and second drive assemblies are connectively coupled to one another by the drive chain 90, specifically extending from the first plate sprocket to the secondary plate sprocket. Suitably serving as means for fixed positioning of the second drive assembly 16 within the chassis 12 is an intermediate axle 110 of cylindrical form extending lengthwise through an inner bore 112 extending longitudinally through the stepped hub. A retaining clip 114 of the type described for use with the first drive assembly 14 is fitted within an annular groove 116 positioned at each of two ends 118*a*, 118*b* of the intermediate axle 110, as in the manner shown in FIG. 1. A pair of flange bearings 120 mountable onto the intermediate axle and partially housed within the inner bore 112, configurably arranged in the same manner as those used for the first drive assembly 14, promotes unhindered rotatable operation of the stepped hub 96 and primary and secondary plate sprockets within the chassis 12.

Figure 12:
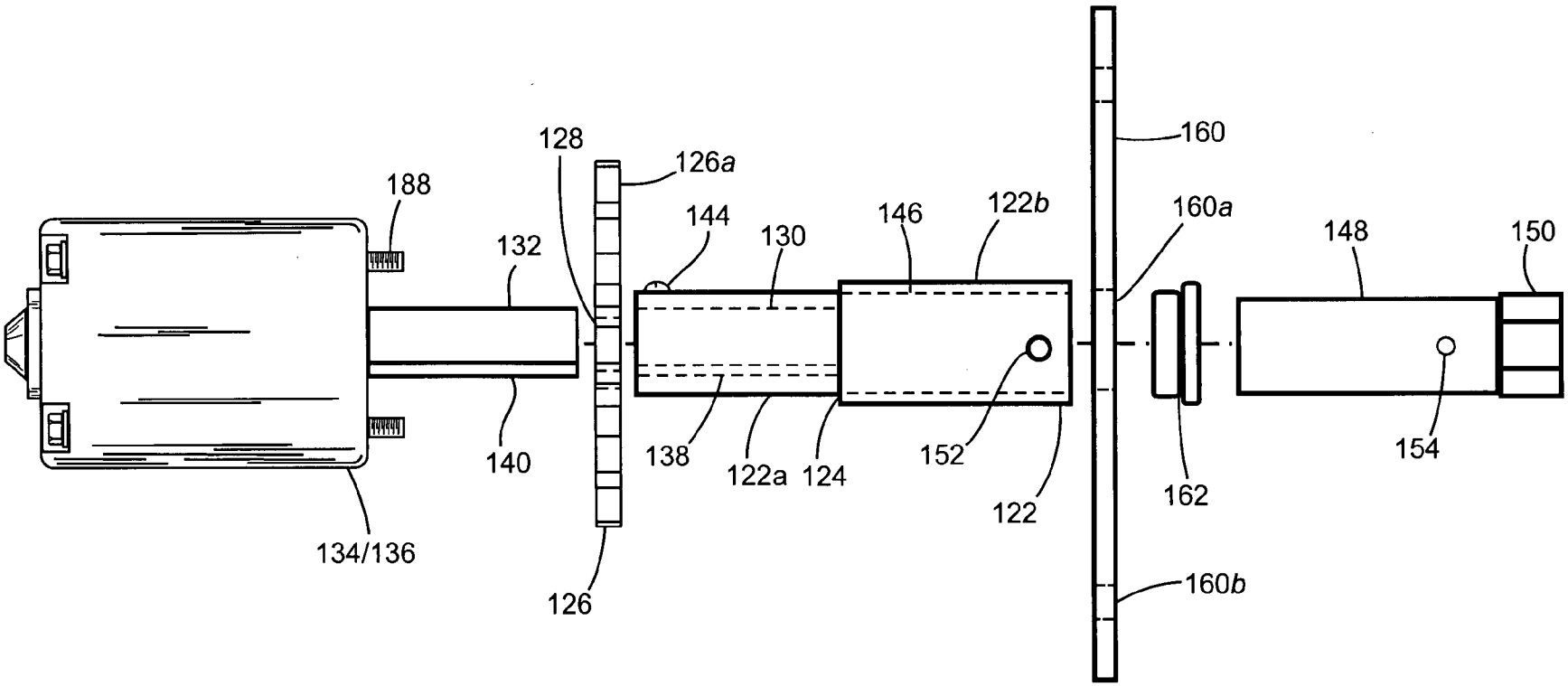
FIG. 12 is a disassembled, side view of the present invention illustrating a third drive assembly comprising a plate sprocket apart from an electric motor, mount plate, and a motor hub having primary and secondary cylindrical surfaces.
Figure 13:
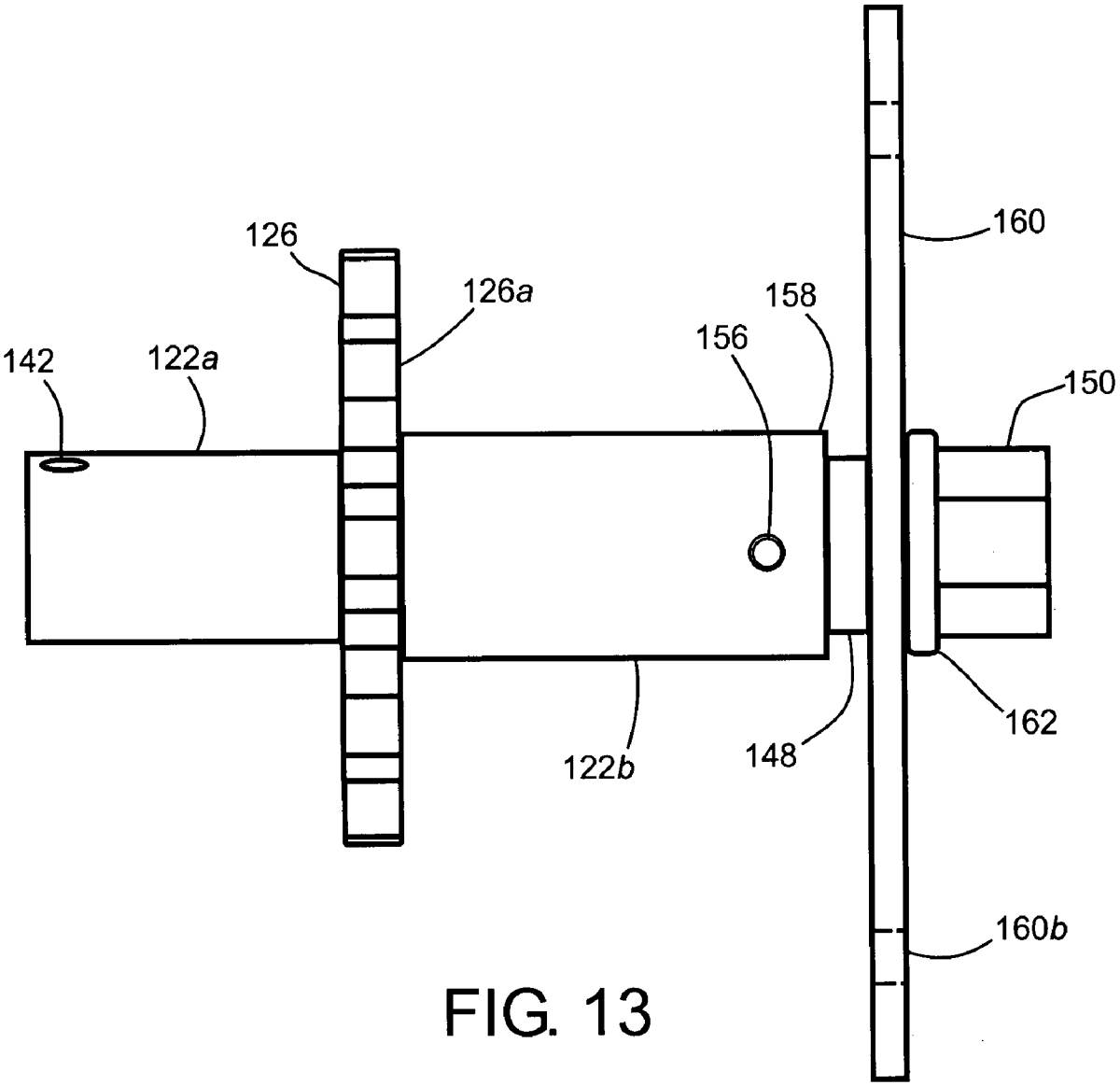
FIG. 13 is a side view of the present invention illustrating a third drive assembly attached to a mount plate for attachment to a back mount plate of a chassis.
Figure 14:
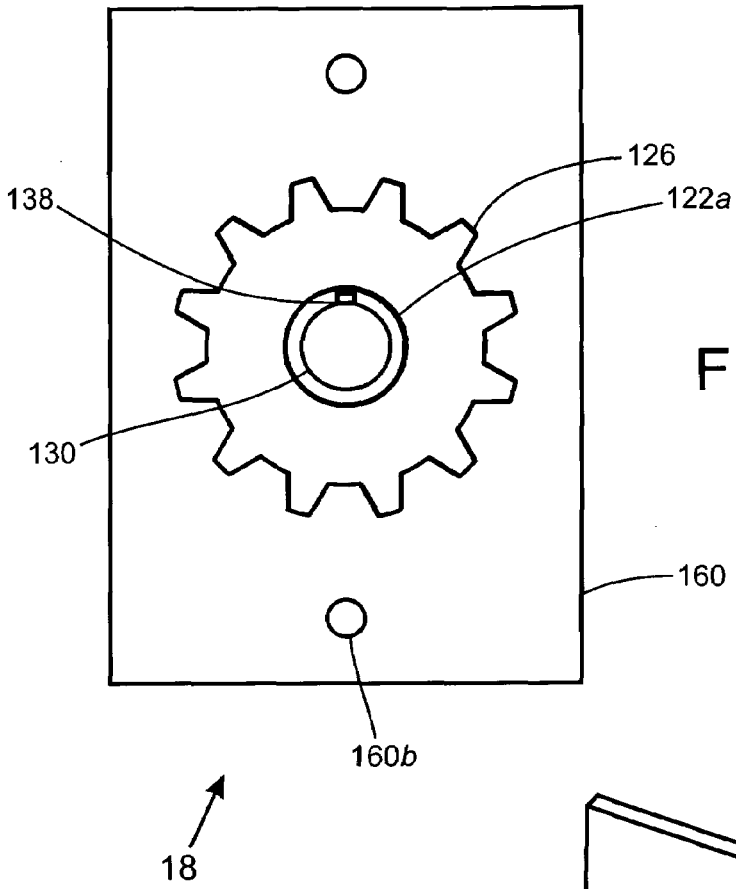
FIG. 14 is a front view of the present invention illustrating a third drive assembly comprising a plate sprocket mounted on a motor hub having primary and secondary cylindrical surfaces.
Figure 15:
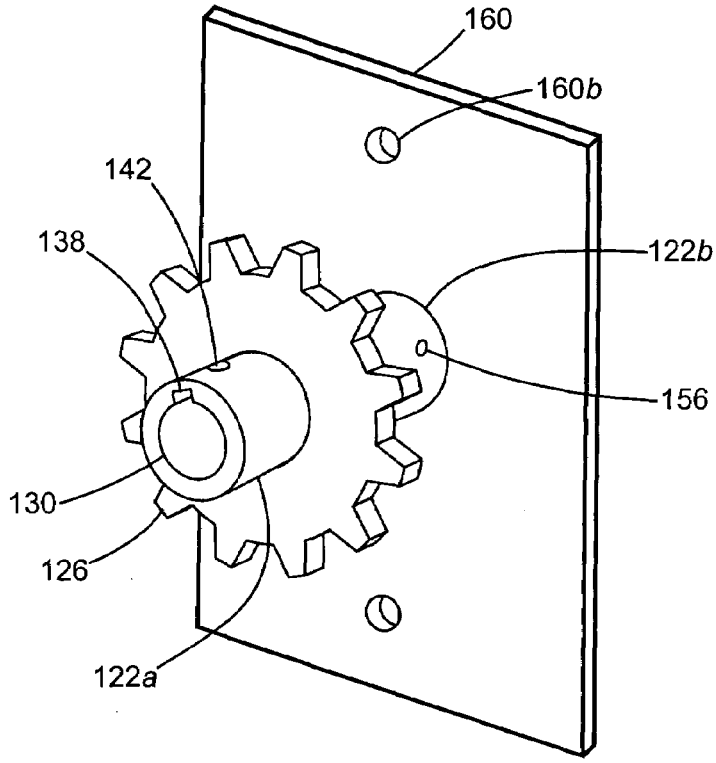
FIG. 15 is a perspective view of the present invention illustrating a third drive assembly attached to a mount plate suitably serving as means for attachment to a back mount plate of a chassis.

The third drive assembly 18, as depicted in FIG. 12, comprises a motor hub 122 having primary and secondary cylindrical surfaces 122*a*, 122*b* each of a differing diameter to collectively form an annular wall 124 thereinbetween. As further shown in FIG. 12, a plate sprocket 126 having a 12-tooth configuration and an aperture 128 extending therethrough at its center is fitted onto the primary cylindrical surface 122*a* and slidably positioned thereabout until it abuts up against the annular wall 124. The 12-tooth plate sprocket is fixedly attached to the primary cylindrical surface by a bead of weld positioned along a seam formed in between the annular wall and inner wall 126*a* of the 12-tooth plate sprocket. Positioned within the primary cylindrical surface, as shown in FIGS. 13 and 14, is a first elongate bore 130 extending longitudinally thereabout to receive and house therewithin a portion of an output shaft 132 of either a 110/220-volt or a 12/24-volt electric motor 134, 136. To ensure unison rotational operation of the output shaft and motor hub, the first elongate bore comprises a keyway 138 extending longitudinally thereabout and in communication therewith to accept an equally configured key 140 extending along and outwardly from the output shaft 132. A pair of threaded apertures 142 extending through and perpendicular to the primary cylindrical surface 122*a* each receive a set screw 144 to lock the output shaft to the motor hub 122 insofar to maintain positioning within the first elongate bore during rotational movement. Like the primary cylindrical surface, the secondary cylindrical surface 122*b* comprises a second elongate bore 146 for receiving and housing therein an axle 148 having a hex-shaped head 150 at one end primarily serving as mechanical means for turning the motor hub without the assistance of the electric motor 134, 136 and an aperture 152 in alignment with a cylindrical cavity 154 extending inwardly into the axle for receiving therethrough and resting therein an expansion pin 156 to lock the axle 148 to the motor hub. Situated in between the hex-shaped head and an end 158 of the secondary cylindrical surface 122*b* is a mount plate 160 substantially serving as means for attaching the motor hub to the back mount plate 12*b* of the chassis 12. A flange bearing 162 of the type noted above for use with the first and second drive assemblies 14, 16 is press-fitted within an aperture 160*a* extending through the mount plate and extends inwardly a predetermined distance beyond the mount plate to serve in maintaining adequate clearance of approximately ⅛" between the back mount plate 12*b* and secondary cylindrical surface for unhindered rotational motion of the motor hub, as best illustrated in FIG. 1. As shown in FIG. 15, a pair of mounting apertures 160*b* integrally made part of the mount plate 160 and in alignment with a first pair of elongate slots 166 extending through the back mount plate 12*b* of the chassis 12 suitably accept therethrough a pair of mount bolts 164 which collectively serve as means for attaching and adjusting the motor hub 122 to the chassis 12 and tensioning a motor drive chain 168 extending from the 40-tooth primary plate sprocket of the second drive assembly 16 to the 12-tooth plate sprocket of the third drive assembly 18.

Figure 16:
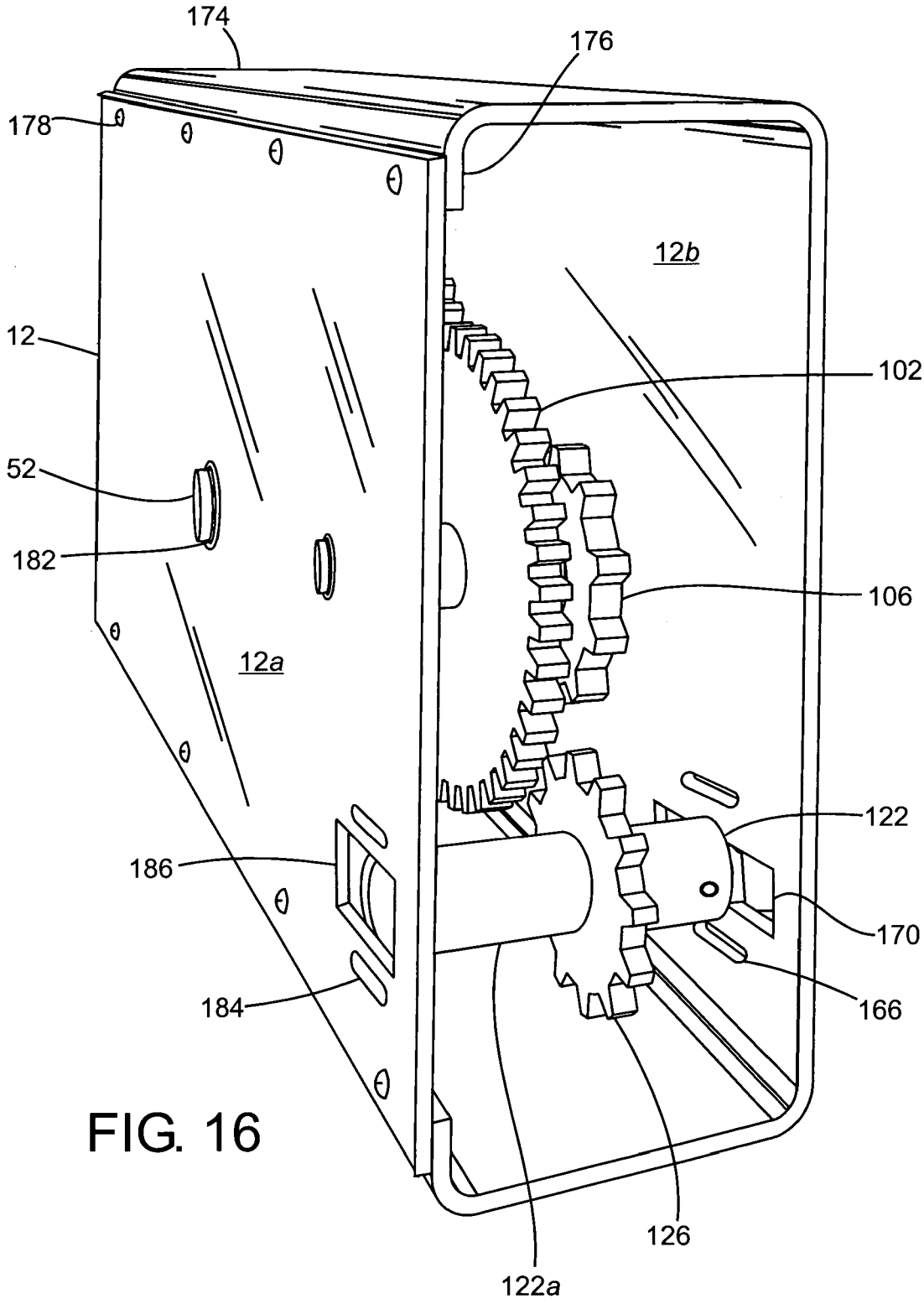
FIG. 16 is a perspective view of the present invention illustrating three drive assemblies mounted to a back mount plate and a front access plate attached to a pair of inwardly positioned ledges of a chassis.

As illustrated in FIGS. 2 and 16, the back mount plate 12*b* of the chassis comprises a square-shaped aperture 170 to permit passage of the axle 148 and a pair of apertures 172*a*, 172*b* for receiving ends of the cable shaft 52 and intermediate axle 110 of the first and second drive assemblies, respectively. In furthering the protection of the drive assemblies, the back mount plate comprises a pair of integral sides 174 extending outwardly therefrom with each integral side having an inwardly positioned ledge 176 substantially serving as a location for mounting the front access plate to the chassis 12 through use of a plurality of press-in fasteners 178 or an equivalent type of fastener known in the art. The electric motor 134, 136 in the preferred embodiment is mounted externally to the chassis 12 and is protected from inclement weather and moisture by a motor/electric circuit cover 180 having a pair of elongate flanges 180*a* for mounting onto the front access plate 12*a*. Mounting of the motor occurs primarily at two locations, namely by the motor's output shaft coupled to the motor hub and externally to the chassis 12 at the front access plate. Like the back mount plate, the front access plate 12*a* comprises a pair of apertures 182 for receiving ends of the cable shaft 52 and intermediate axle 110 of the first and second drive assemblies, respectively, and are suitably arranged in alignment with the apertures 172*a*, 172*b* extending through the back mount plate, notably apparent in the instance where the front access plate is positioned onto the inwardly positioned ledge 176 and held thereat by the press-in fasteners 178. A second pair of elongate slots 184 and an opening 186 situated thereinbetween is also provided for the front access plate for receiving therethrough a pair of motor mount bolts 188 and the motor's output shaft, respectively. The opening as well as the second elongate slots, as depicted in FIG. 15, provide adequate space for movability of the motor 134, 136 to selectively adjust and tension the motor drive chain 168 in conjunction with the structural configuration of the mount plate 160 noted herein for mounting the motor hub 122 to the chassis 12.

The winch assembly 10 further comprises independent 110/220- and 12/24-volt electrical circuits 190, 192 mounted on boards housed within the motor/electric circuit cover 180 for powering the 110/220-volt or 12/24-volt electric motors 134, 136 to set in rotatable motion the three drive assemblies. The 110/220-volt electrical circuit preferably comprises a power supply sub-circuit 194 coupled to an outside power source, a brake effects delay sub-circuit 196 coupled thereto for delaying the transmission of power to the motor to the extent of cooperating with the electrical features and requirements thereof, and operational means for controlling the supply of power to the motor, which preferably comprises a switching sub-circuit 198 for local operation, as shown in FIG. 17, or independently thereof, a remote control sub-circuit 200 for both local and remote operation.

Figure 18:
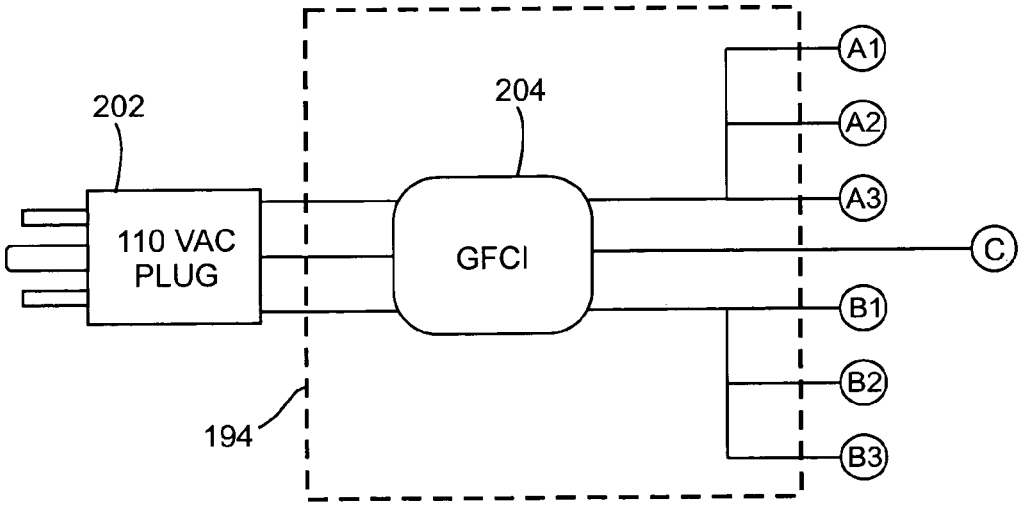
FIG. 18 is an electrical schematic of the present invention illustrating a power supply sub-circuit for supplying power to a brakes effects delay sub-circuit and a remote control sub-circuit for selective operation of a 110/220-volt electric motor.
Figure 19:
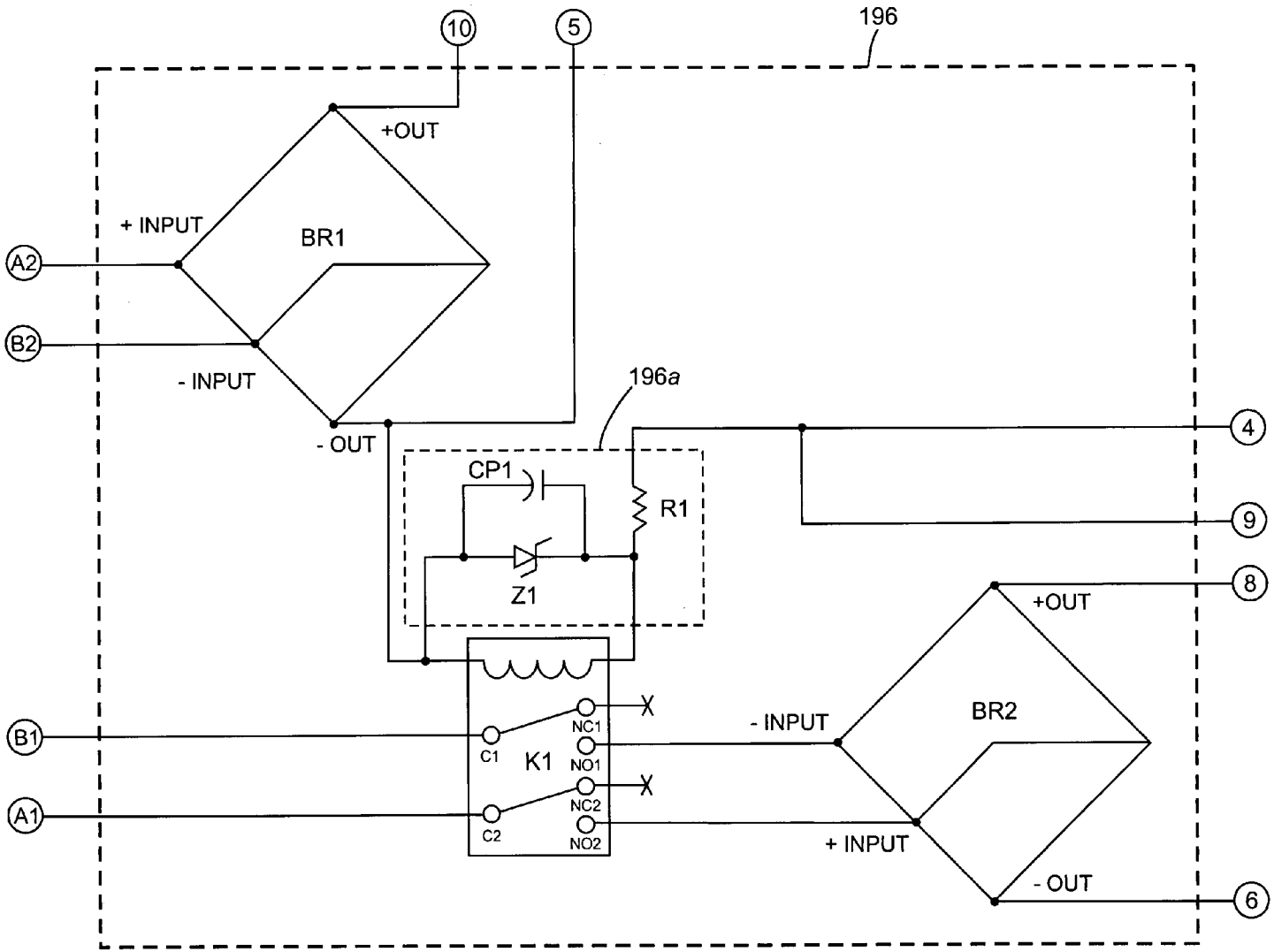
FIG. 19 is an electrical schematic of the present invention illustrating a brake effects delay sub-circuit comprising a time delayed sub-circuit collectively configured for operation with a 110/220-volt power supply and electric motor.

As depicted in FIG. 18, the power supply sub-circuit 194 receives 110/220 VAC from an outside available source via a three-pronged plug 202 which correspondingly transmits the resultant power to a ground-fault circuit interrupter 204 or GFCI rated at 15 amps, preferably of the type known and used in the art to safeguard against electrical-related injury caused by overloading or short circuiting of the power receiving circuitry such as the brake effects delay sub-circuit 196 noted herein. Following the GFCI, the power supply is divided into discrete outputs denoted herein as power line outputs A1, A2, A3, B1, B2, B3, and C. Power line outputs A1 and B1 feed 110/220 VAC power to a first portion of the brake effects delay sub-circuit, more specifically to contacts C1 and C2 of relay K1, wherein each contact C1, C2 is switchably operable between a normally closed position NC1, NC2 shunted to ground and a normally open position NO1, NO2, respectively, as best illustrated in FIG. 19. Power line outputs A2 and B2, on the other hand, feed 110/220 VAC power to a second portion of the brake effects delay sub-circuit 196, namely a first bridge rectifier BR1 whose ±outputs are respectively coupled to the switching sub-circuit and negative input of a time delayed circuit 196*a* integrally made part of the brake effects delay sub-circuit, preferably comprising a zener diode Z1, capacitor CP1, and resistor R1, as shown in FIG. 19. Power into a second bridge rectifier BR2, which comprises ±inputs coupled to NO1 and NO2 of K1, respectively, primarily occurs upon the predetermined conditions of the time delayed circuit, namely Z1, CP1, and R1, and its operable delaying impact on K1 to receive and transmit power via the connections maintained at C1 and NO1 and C2 and NO2. In other words, K1 is effectively delayed from being pulled in by the time delayed circuit 196*a* until the numeric value of Z1 is reached. For instance, power into and passing through R1, as selectively controlled at the switching sub-circuit 198, starts to charge CP1 at the rate of T=RC, which is limited in its upper value by Z1 of approximately 13 VDC. Accordingly, relay K1 is pulled in at approximately 9 VDC, effectively causing a delay of approximately 70% of the RC time constant equating to a time factor of 500 milliseconds. The delaying effect of the time delayed circuit on K1 allows time for the brake on the electric motor 134 to be released, but not enough time for the kinetic force of the load to commence a downward descent before the motor turns on in which case can cause excessive current draw from the motor and successive damage to the switching sub-circuit. After the delay is timed out, K1 is pulled in and provides 110/220 VAC to BR2 which rectifies the power input to ±110/220 VDC for compatible input into the 110/220-volt motor 134 via the switching sub-circuit 198.

Figure 17:
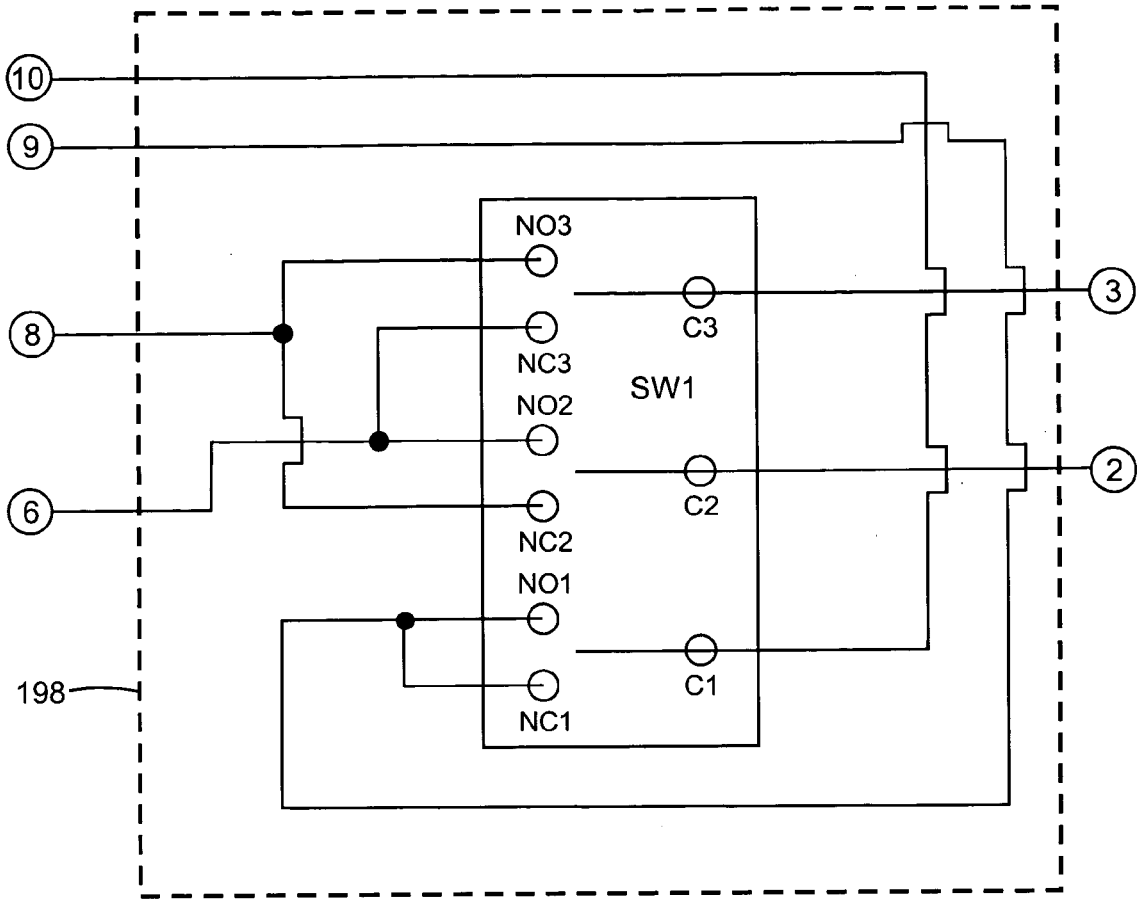
FIG. 17 is an electrical schematic of the present invention illustrating a switching sub-circuit for selective control of a 110/220-volt electric motor.

Referring now to FIG. 17, the switching sub-circuit 198 is primarily a three-positionable switch SW1 (up-stop-down) operated locally at the winch assembly 10. In the preferred embodiment, SW1 accepts ±110/220 VDC from BR2 at connections NC2 jumped to NO3 and NO2 jumped to NC3. As best illustrated in FIG. 19, C2 and C3 of SW1 are coupled to power input terminals of the 110/220-volt electric motor designated as M1*a* and M1*b*, respectively. The electrical configuration of SW1 and its outputs to M1*a* and M1*b* allows the 110/220-volt electric motor to suitably operate in forward or backward fashion to set in motion the drive assemblies in an upward or downward mode, respectively. Also shown in FIGS. 17 and 19, the positive output from BR1 is coupled to C1 of SW1, which is switchably operated between normally open NO1 or normally closed NC1 to selectively provide power to R1 and to an input terminal M1*c* of the 110/220-volt electric motor 134. The negative output from BR1, on the other hand, is coupled to the negative input of the time delayed sub-circuit 196*a*, as hereinbefore described, and directly to an input terminal M1*d* of the 110/220-volt electric motor.

Figure 20:
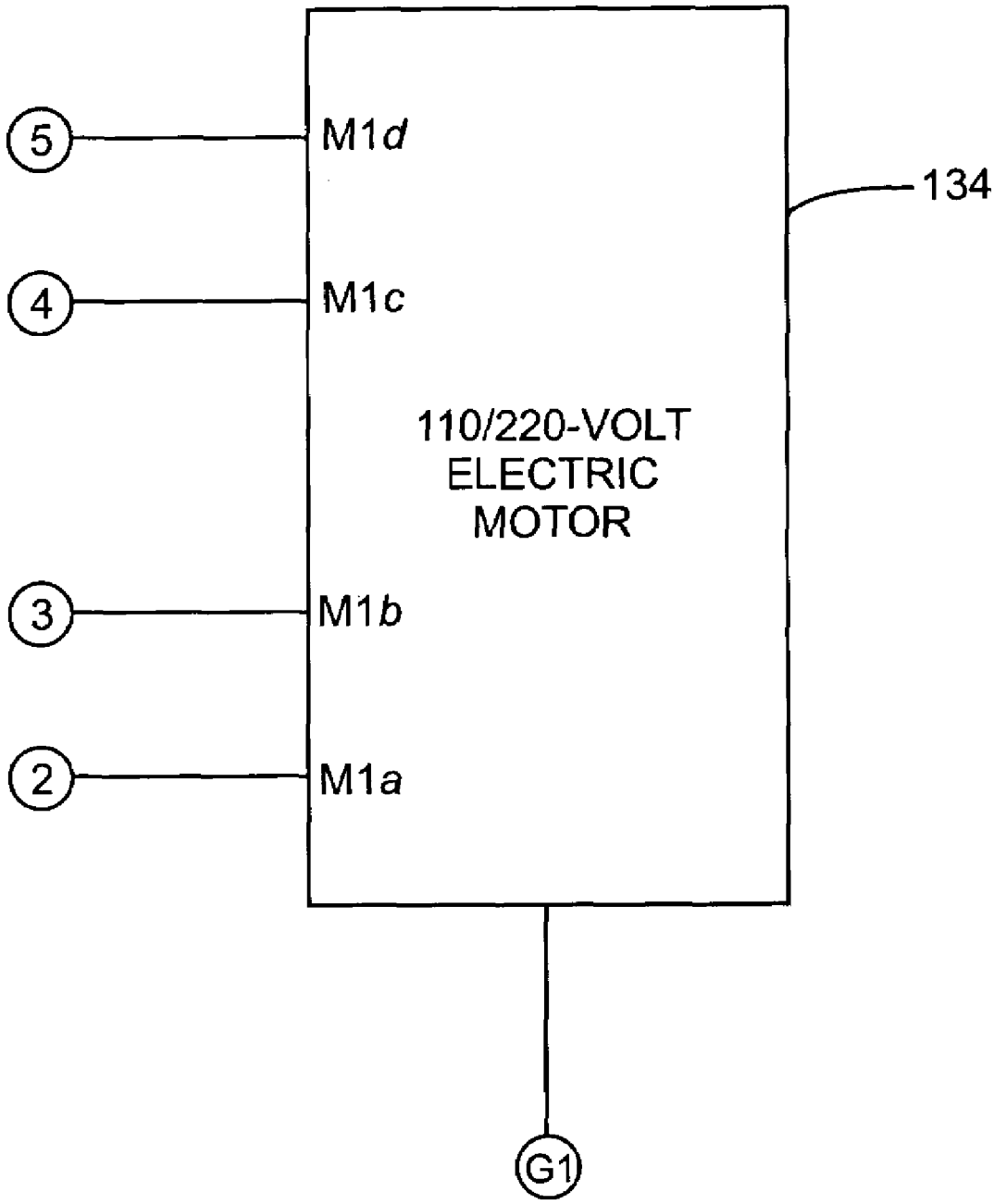
FIG. 20 is an electrical schematic of the present invention illustrating electrical connections for a 110/220-volt electric motor.

Power line output C, which serves as a path to ground, is coupled to a ground input of the 110/220-volt electric motor designated as G1, as shown in FIG. 20.

Figure 21:
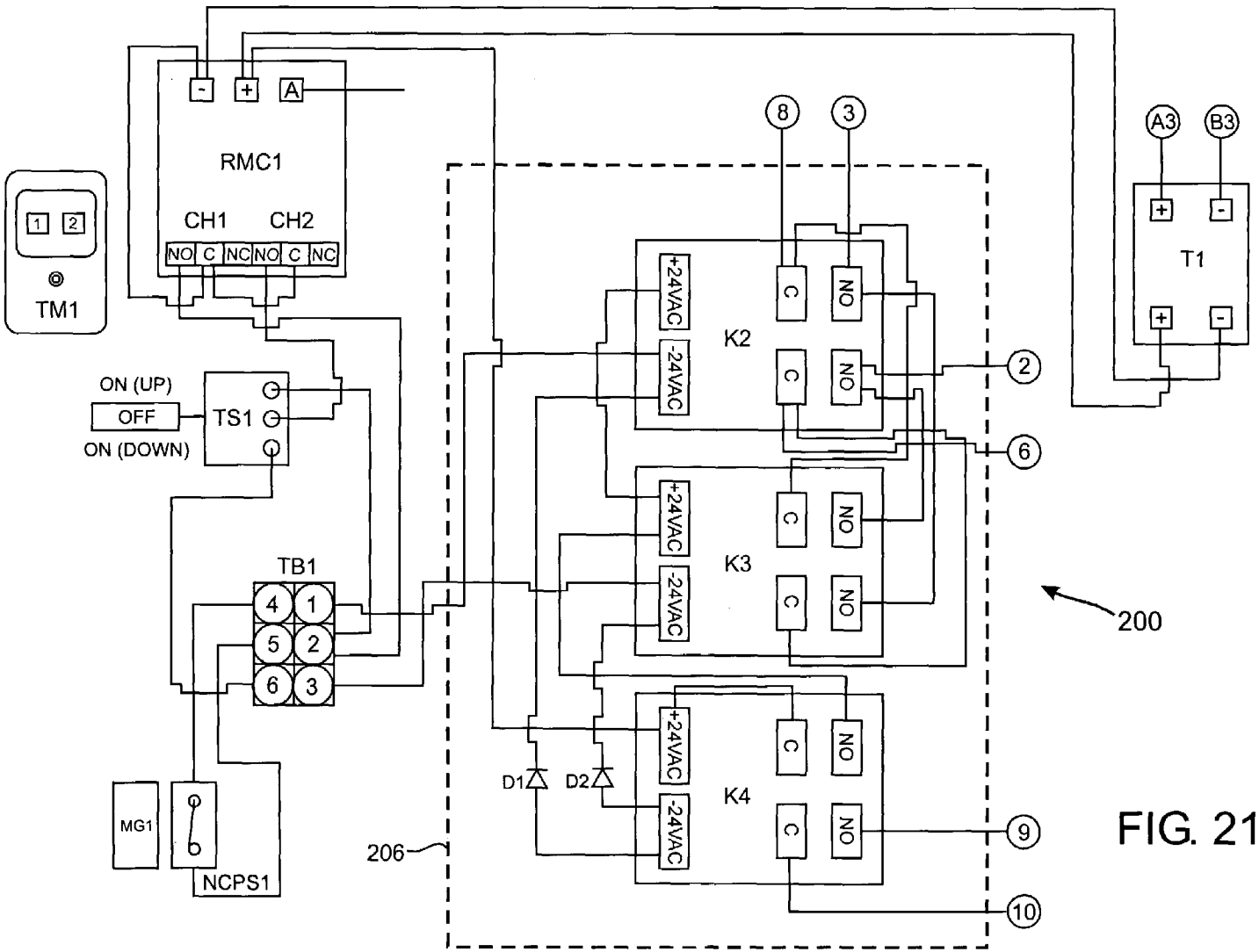
FIG. 21 is an electrical schematic of the present invention illustrating a remote control sub-circuit having a relay set for selective operation of a 110/220-volt electric motor, particularly in directional modes of forward, reverse, and stop.

The remote control sub-circuit 200 operates independent of SW1 to control the function of the 110/220-volt electric motor and the brake effects delay sub-circuit 196 from a distance of approximately 150 yards from the winch assembly 10 via a hand-held transmitter TM1 operable at a predetermined frequency to suitably correspond with that of the remote control unit RMC1 and locally at the winch assembly via a three-positionable toggle switch TS1 (up-stop-down). An antenna A is provided at RMC1 to ensure sufficient frequency transmission and reception for distant operation of TM1. As shown in FIG. 21, power line inputs A3 and B3 supply power to a localized power transformer T1 which steps down the incoming power of 110/220 VAC to 24 VAC to establish compatible operation with a two channel remote control unit RMC1 as well as other electrical components noted in the remote control circuitry. Positive and negative outputs from T1 are suitably coupled to ±inputs of RMC1 while the positive input is branched and provides +24 VAC power into a relay set 206 comprising three dedicated relays K2, K3, and K4, with each relay being specifically assigned for operating the 110/220-volt electric motor in directional modes of forward, reverse, and braking in contemporaneous operation with the drive assemblies to raise, lower and stop the boat lift platform 22, respectively. The dedicated relays, as illustrated in FIG. 21, are suitably coupled to one another to perform in compatible fashion with the brake effects delay sub-circuit 196 and act accordingly in setting forth the delay of power to the 110/220-volt electric motor 134. Like SW1, the relay set receives +110/220 VDC power from BR1 and BR2 and −110/220 VDC power from BR2. More specifically, K4 (braking relay) receives +110/220 VDC from BR1 and comprises an output passing through R1 to power the time delayed circuit 196*a* to establish the delay in transmitting power through K1 and into BR2 for rectification. K2 (forward relay), on the other hand, receives ±110/220 VDC from BR2 and comprises outputs directly coupled to the M1*a* and M1*b* terminals of the 110/220-volt electric motor. As illustrated in FIG. 21, the remote control sub-circuit further comprises a normally closed proximity switch NCPS1 coupled to K2. In its capacity as a safety device to prevent damage to the 110/220-volt electric motor and accompanying circuitry, NCPS1 is operably activated in an open position upon a magnet MG1 attached to a predetermined position on the boat lift structure passes or travels by the NCPS1 during operation. In other words, as the magnet MG1 attached to the boat lift structure passes NCPS1, NCPS1 is activated and held an open state to disconnect power flow into and through K2 and into the 110/220-volt electric motor to stop the upward travel of the boat lift structure.

Table 1 presented below lists the values of the circuit components described hereinbefore and shown in FIGS. 17–21 for the 110/220-volt electrical circuit suitably configured for operation of the 110/220-volt electric motor. However, it is to be understood that the invention is not limited to the precise circuit values or even the specific embodiment described above, and no limitation with respect to the specific apparatus illustrated herein is intended or should be inferred. It can be appreciated that numerous variations and modifications may be effected without departing from the true spirit and scope of the novel concept of the invention.

TABLE 1

| | |
|---|---|
| BR1 | Bridge Rectifier, 25 amps, 200 PIV |
| BR2 | Bridge Rectifier, 35 amps, 600 PIV |
| K1 | Relay, 30 amps, DPST, 12/24 VDC |
| K2, K3, K4 | Relay, 30 amps, DPST, 24 VAC |
| R1 | Resistor, 25 watt, 1000 ohm |
| Z1 | Zener Diode, 5 watt, 13 volt |
| CP1 | Capacitor, 1000 uf/25 v |
| SW1 | Three Position Switch (mom-off-mom), 15 amp, 3PDT |
| NCPS1 | Normally Closed Proximity Switch (mom-off-mom), 15 amp, 3PDT |
| T1 | Transformer, 450 milliamps, 110/220 VAC-24 VAC |
| D1, D2 | Diodes, 1N4003 |
| TB1 | Terminal Block, double row, 4 positions |
| RMC1 | Remote Control Unit, Model No. GLR43302, 433 MHz, 12/24 VDC, 15 amp |
| TM1 | Hand-held Transmitter with Adjustable Frequency Settings @ 433 MHz |
| TS1 | Three Position Switch (mom-off-mom), 15 amp, 3PDT |
| GFCI | Ground-fault Circuit Interrupter, 15 amps |
| Electric Motor | 110/220 VDC, 91 rpm, Gear Reduced 2- or 3-Stage |
| Three-pronged Plug | 15 amps |

Figure 22:
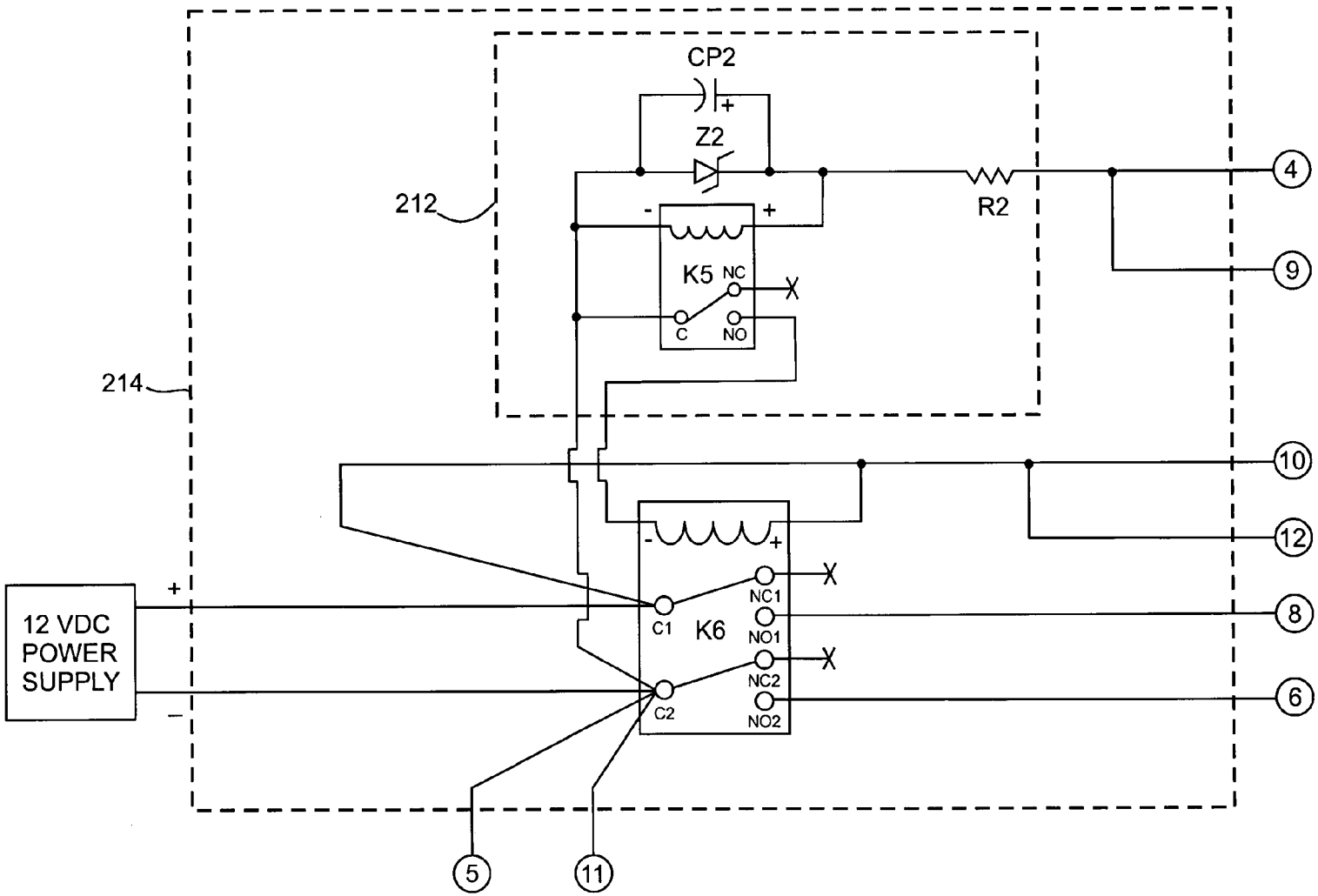
FIG. 22 is an electrical schematic of the present invention illustrating a brake effects delay sub-circuit comprising a time delayed sub-circuit collectively configured for operation with a 12/24-volt power supply.

Referring now to FIGS. 22–25, the 12/24-volt electrical circuit 192 suitably configured for powering the electric motor operates similarly in most part to the 110/220-volt electrical circuit as described above with exception that it lacks rectifying circuitry to convert the incoming power from AC to DC and comprises an electric motor operable at 12/24 VDC 136. In other respects, the 12/24-volt electrical circuit comprises a switching sub-circuit 208 for controlling the transmission of power to the 12/24-volt electric motor locally at the winch assembly 10 or a remote control sub-circuit 210 for both local and remote operation. Like the 110/220 VAC electrical circuit noted above, a time delayed sub-circuit 212 is integrally made part of a brake effects delay sub-circuit 214, but further comprises a reed relay denoted herein as K5. As shown in FIG. 22, a second relay K6 of the brake effects delay sub-circuit receives ±12/24 VDC from an external power source, such as a locally placed 12/24-volt battery, at connections C1 and C2 of K6, wherein each connection is operably switchable between normally closed NC1, NC2 shunted to ground and normally open NO1, NO2, respectively. The incoming −12/24 VDC at C2 of K6 is further divided to provide power directly into the motor at M2*a* and to the time delayed sub-circuit 212 comprising a capacitor CP2, a zener diode Z2, and a resistor R2, each operating at a different value to that described for the 110/220 VAC electrical circuit to establish a delay that is most compatible with the electrical circuitry and requirements of the 12/24-volt electric motor 136. Operating similarly as the 110/220 VAC electrical circuit, K6 is effectively delayed from being pulled in by the time delayed sub-circuit until the numeric value of Z2 is reached. For instance, power into and passing through R2, as selectively controlled at the switching sub-circuit, starts to charge CP2 at the rate of T=RC, which is limited in its upper value by Z2 of approximately 5.1 VDC. Accordingly, relay K5 is pulled in at approximately 3.5 VDC, effectively causing a delay of approximately 70% of the RC time constant equating to a time factor of 464 milliseconds. After the noted delay is timed out, as established by the time delayed sub-circuit, K5 is pulled in to provide 12/24 VDC to K6, which in turn passes ±12/24 volts to the switching sub-circuit through connections maintained at C1 and NO1 and C2 and NO2 of relay K6, respectively.

Figure 23:
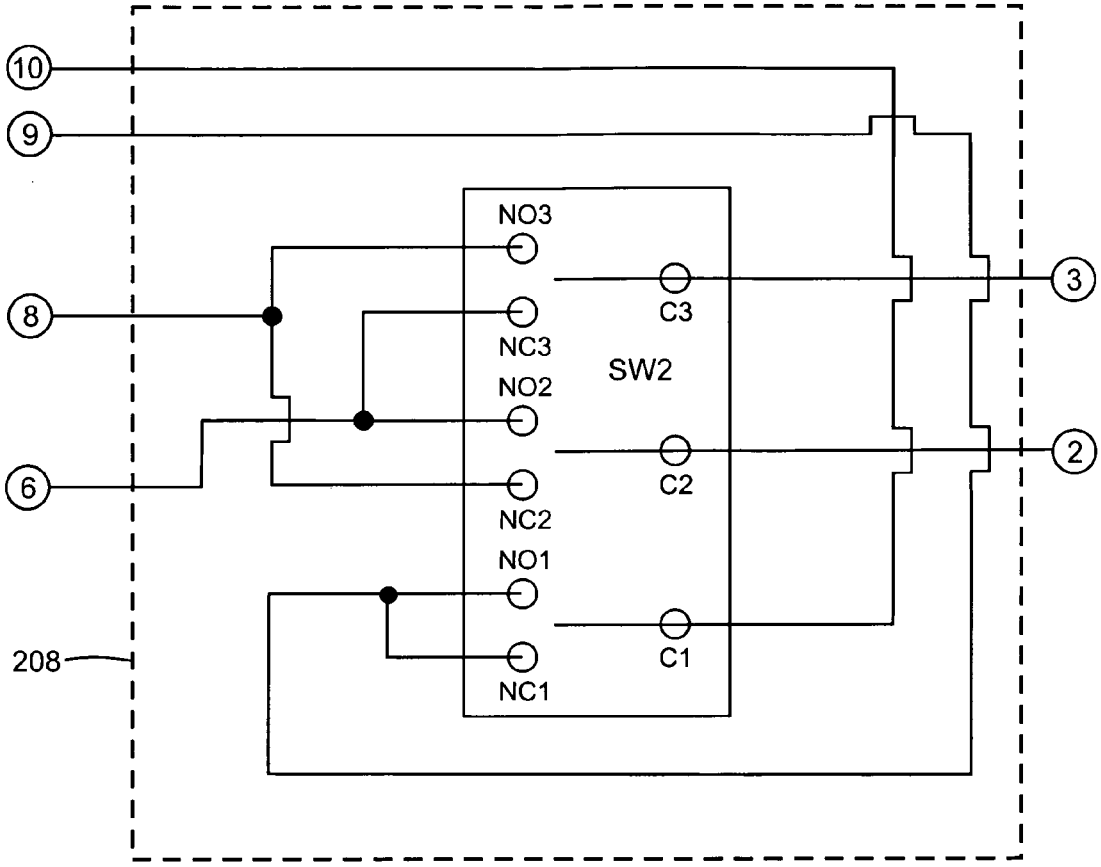
FIG. 23 is an electrical schematic of the present invention illustrating a switching sub-circuit for selective control of a 12/24-volt electric motor.
Figure 24:
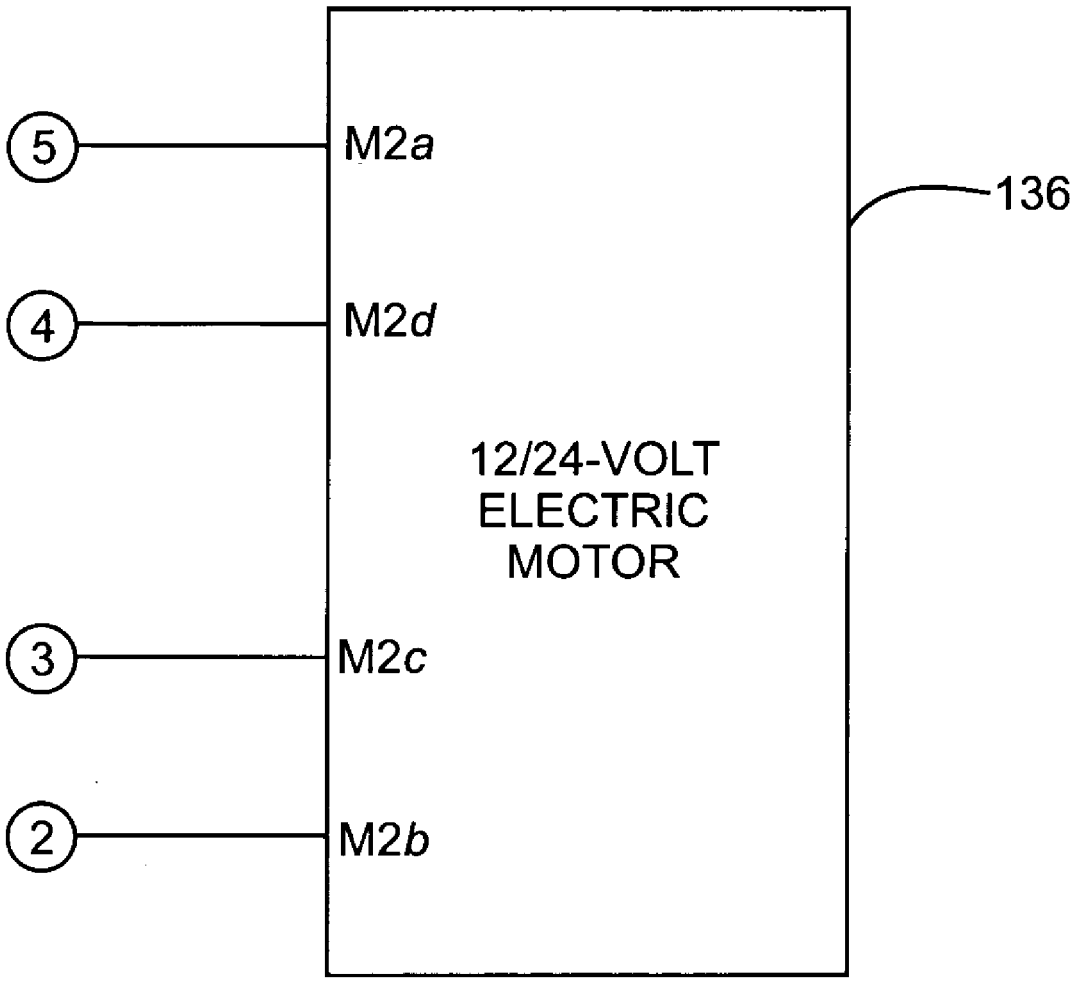
FIG. 24 is an electrical schematic of the present invention illustrating electrical connections for a 12/24-volt electric motor.

Similarly configured as the 110/220-volt electrical circuit, the switching sub-circuit of the 12/24-volt electrical circuit is primarily a three-positionable switch SW2 (up-stop-down) operated locally at the winch assembly 10. Substantially similar to SW1 in terms of configuration, SW2, as shown in FIG. 23 accepts ±12/24 VDC from K6 at connections NC2 jumped to NO3 and NO2 jumped to NC3, respectively. As shown in FIG. 24, C2 and C3 of SW2 are coupled to power input terminals of the 12/24-volt electric motor designated as M2*b* and M2*c*, respectively. The electrical configuration of SW2 and its outputs to M2*b* and M2*c* allows the 12/24-volt electric motor to suitably operate in forward or backward fashion to set in motion the drive assemblies in an upward or downward mode, respectively. As shown in FIG. 22, +12/24 VDC input at C1 of K6 is branched to supply power into C1 of SW2 which is switchably operated between normally open NO1 or normally closed NC1 to selectively provide power to an input terminal M2*d* of the 12/24-volt electric motor and to R2 to invoke the time delayed sub-circuit 212 in the manner described above.

Figure 25:
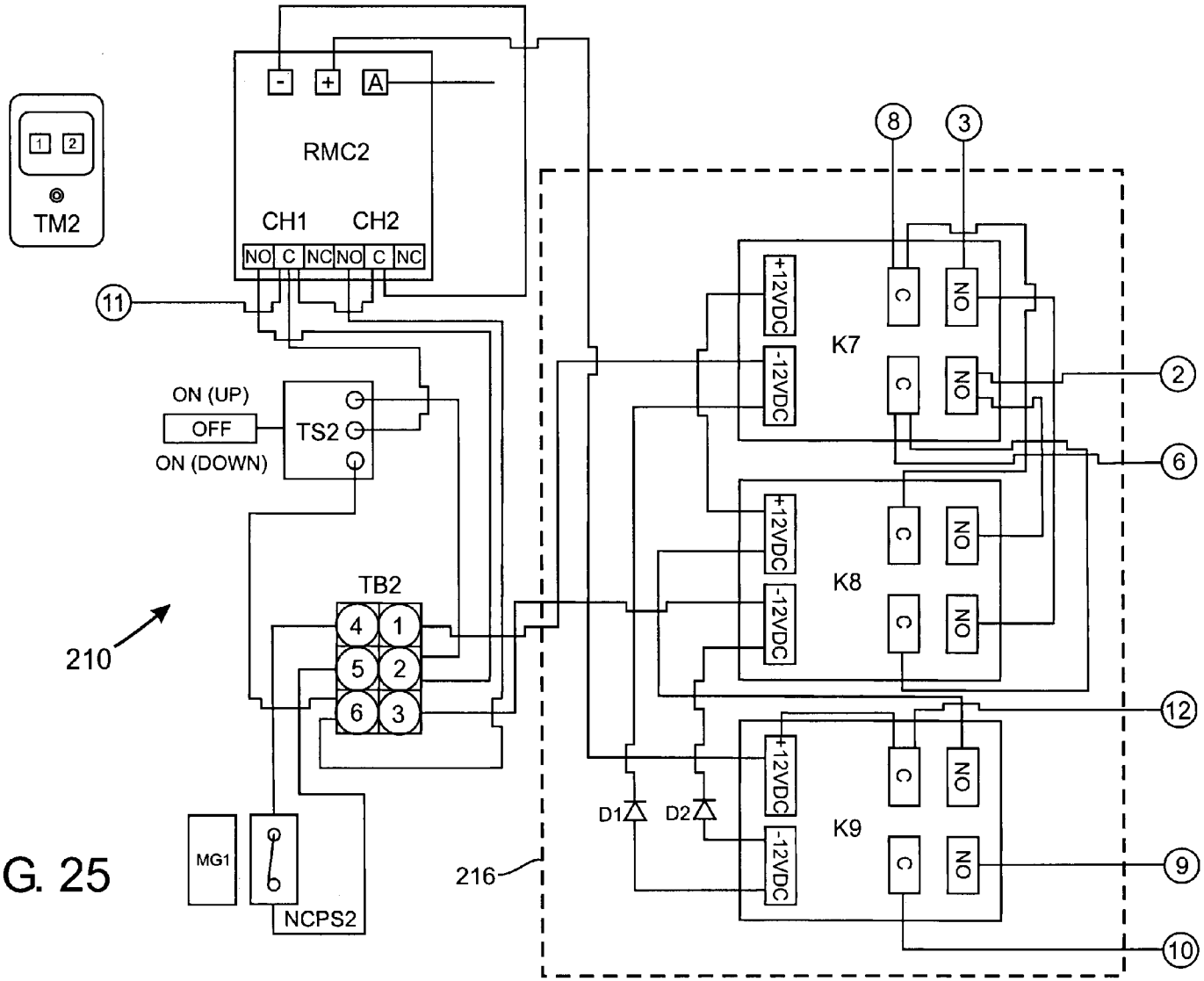
FIG. 25 is an electrical schematic of the present invention illustrating a remote control sub-circuit having a relay set for selective operation of a 12/24-volt electric motor, particularly in directional modes of forward, reverse, and stop.

The remote control sub-circuit 210, as shown in FIG. 25, operates independent of SW2 to control the function of the 12/24-volt electric motor and the brake effects delay sub-circuit from a distance of approximately 150 yards from the winch assembly 10 via a hand-held transmitter TM2 operable at a predetermined frequency to suitably correspond with that of a two-channel remote control unit RMC2 and locally at the winch assembly 10 via a three-positionable toggle switch TS2 (up-stop-down). An antenna A is provided at RMC2 to ensure sufficient frequency transmission and reception for distant operation of TM2. The negative terminal input of RMC2 accepts −12/24 VDC power from the power supply input at C2 of K6 and is further coupled to closed contacts C1, C2 of first and second channels of RMC2 and a −12/24 VDC input terminal (OFF position) of a three-positionable toggle switch TS2. As shown in FIG. 25, the remote control sub-circuit further comprises a relay set 216 having three relays K7, K8, K9 each operably dedicated to allow the 12/24-volt electric motor to function in modes of forward, reverse, and braking for contemporaneous interaction with the drive assemblies to raise, lower, and stop the boat lift platform, respectively. K7 (forward relay) and K8 (reverse relay) are coupled in a manner to simultaneously accept ±12/24 VDC on a delayed basis from K6 and switchably operate to provide and transmit ±12/24 VDC to M2*b* and M2*c* of the 12/24-volt electric motor, respectively. K9 (braking relay), on the other hand, receives +12/24 VDC from C1 of K6 and is switchably coupled to RMC2 to provide power thereat and to M2*d* of the 12/24-volt electric motor and to R2 to invoke the time delayed sub-circuit in the manner described hereinbefore. Like the 110/220-volt electrical circuit, the 12/24-volt electrical circuit comprises a normally closed proximity switch NCPS2 coupled to K7 via connections maintained at a terminal block designated as TB2 in FIG. 25. As noted earlier in more detail, as a magnet MG2 attached to the boat lift structure passes NCPS2, NCPS2 is activated and held an open state to disconnect power flow through K7 and into the 12/24-volt electric motor to the extent of stopping the upward travel of the boat lift platform 22.

Table 2 presented below lists the values of the circuit components described hereinbefore and shown in FIGS. 22–25 for the 12/24-volt electrical circuit suitably configured for operation of the 12/24-volt electric motor. However, it is to be understood that the invention is not limited to the precise circuit values or even the specific embodiment described above, and no limitation with respect to the specific apparatus illustrated herein is intended or should be inferred. It can be appreciated that numerous variations and modifications may be effected without departing from the true spirit and scope of the novel concept of the invention.

TABLE 2

| | |
|---|---|
| K5 | Reed Relay, 5 VDC |
| K6 | Relay, 30 amps, 12/24 VDC |
| K7, K8, K9 | Relay, 30 amps, DPST, 24 VAC |
| R2 | Resistor, 0.4 watt, 464 ohm |
| Z2 | Zener Diode, 0.5 watt, 5.1 volt |
| CP2 | Capacitor, 1000 uf/25 v |
| SW2 | Three Position Switch (mom-off-mom), 15 amp, 3PDT |
| NCPS2 | Normally Closed Proximity Switch (mom-off-mom), 15 amp, 3PDT |
| TS2 | Three Position Toggle Switch |
| D1, D2 | Diodes, 1N4003 |
| TB2 | Terminal Block, double row, 4 positions |
| RMC2 | Remote Control Unit, Model No. GLR43302, 433 MHz, 12/24 VDC, 15 amps |
| TM2 | Hand-held Transmitter with Adjustable Frequency Settings @ 433 MHz |
| Battery | 12 volts, 1000 amps |
| Electric Motor | 12/24 VDC, 112 rpm, Gear Reduced 2- or 3-Stage |

Operation of the winch assembly 10 may be made through selective manipulation of the local switch SW1, SW2 or if independently wired with the remote control sub-circuit 200, 210, through the local toggle switch TS1, TS2 and hand-held transmitter TM1, TM2 which actively interacts at a predetermined frequency with RMC1, RMC2 for the 110/220- and 12/24-volt electrical circuits, respectively. Toggling SW1, SW2 or TS1, TS2 at the up or down position suitably sets in motion the forward and reverse movement of the electric motor 134, 136 in contemporaneous operation with the drive assemblies 14, 16, 18 which results in upward or downward movement of the boat lift platform 22, respectively. Momentary release of SW1, SW2 or TS1, TS2 at the up or down position actively positions the switch to OFF, which accordingly stops the upward or downward travel of the boat lift platform. Inherent in the electric motor's design is an electronic brake which acting in concert with the brake effects delay sub-circuit 196, 214 external thereto safely holds and retains positioning of the boat lift platform with or without the presence of a predetermined load. As noted hereinbefore, the brakes effects delay sub-circuit cooperatively operates in conjunction with the circuitry of the electric motor's brake to prevent premature failure by transmitting power to the electric motor after a pre-set time delay.

After the noted delay, power is freely transmitted via SW1, SW2 or TS1, TS2 to the electric motor to subsequently activate the forward and reverse direction of the windings inherently made part thereof.

It can be seen from the foregoing that there is provided in accordance with this invention a simple and easily operated device which readily replaces typical prior art devices comprising manual means for lowering and raising a boat lift platform 22. The winch assembly 10 is completely functional in an outdoor setting, preferably being positioned alongside a floating or fixed-positioned dock for automated lifting and lowering of a hull support platform commonly known in the art to support recreational boats weighing in the range classification of 2,000–8,000 pounds. It is obvious that the components comprising the winch assembly 10 may be fabricated from a variety of materials, providing such selection or use of materials possess the capacity to withstand forces acting thereon throughout its duration of use in raising and lowering a boat lift platform and protects vital operating components, including the electrical circuitry and electric motor noted above. Accordingly, it is most desirable, and therefore preferred, to construct the three drive assemblies 14, 16, 18 from high tensile, high alloy steel material, desirably from material having a tensile strength of approximately 125,000 p.s.i. The several plate sprockets made part of the drive assemblies are desirably straight spur gears so that no substantial thrust forces are produced to require special thrust bearings beyond that of the flange bearings noted hereinbefore for smooth rotational operation. Given the presence of a moisture-laden environment for which the winch assembly 10 operates, the chassis 12 is preferably constructed from materials specifically suited to guard against premature corrosion, such as aluminum or plate steel coated with a corrosive-resisting material. In furthering the need to protect the winch assembly during inclement weather and provide for greater access for repair and maintenance, the electric motor 134, 136 is housed externally to the chassis. Although the chassis 12 supplements in protecting the drive assemblies from moisture, its primary purpose is to ensure adequate support of the drive assemblies to further ensure a tolerable alignment condition of the plate sprockets for smooth rotational operation. Accordingly, the chassis and the electric motor/electrical circuit cover are respectfully fabricated from at least 0.1875 and 0.0630 plate aluminum to provide the noted strength. Although the 12/24-volt electrical circuit primarily operates from a nearby 12/24-volt power source, such as a battery, there may be instances where a battery is preferably used in a remote location, but may become inoperative as a result of sustained usage over a set timeframe. In this case, the battery may be suitably coupled to a solar panel of the type known in the art having means for re-generating power to the battery insofar to sustain operation of the 12/24-volt electrical circuit. The type most suited for this application is Model No. 10009 (Battery Saver Pro5W) as manufactured by ICP Solar Technologies, Inc., located in Montreal, Quebec, Canada.

While there has been shown and described a particular embodiment of the invention, it will be obvious to those skilled in the art that various changes and alterations can be made therein without departing from the invention and, therefore, it is aimed in the appended claims to cover all such changes and alterations which fall within the true spirit and scope of the invention.

What is claimed is:

1. A winch assembly for automated lifting and lowering of a v-shaped platform of a boat lift structure, said assembly comprising in combination:

a chassis having back mount and front access plates collectively arranged to mount and house therein first, second, and third drive assemblies, said first drive assembly comprising a first plate sprocket mounted to a spool assembly for concurrent operation therewith, said spool assembly comprising a cable hub having a pair of outwardly extending supports and a cabling barrel positioned thereinbetween and of larger diameter than said extending supports to collectively form adjoining surface area for attaching a pair of cable guards thereagainst to maintain localized positioning of a predetermined amount of cabling wound onto and attached at one end to said cabling barrel with a second end thereof being attached to the v-shaped platform, said cable hub having an axial bore extending lengthwise thereof for receiving therethrough and housing therein a cable shaft having first and second ends engaging said back mount and front access plates, respectively, said second drive assembly comprising a stepped hub of integral construction having three discrete cylindrical surfaces each of a predetermined diameter to form first and second annular walls and an inner bore extending lengthwise therethrough for accepting therein an intermediate axle, said first cylindrical surface having a primary plate sprocket positioned thereon and fixedly attached to said first annular wall, said third cylindrical surface having a secondary plate sprocket positioned thereon and fixedly attached to said second annular wall, said intermediate axle having first and second ends engaging said front access and back mount plates, respectively, said third drive assembly comprising a motor hub having primary and secondary cylindrical surfaces each of a differing diameter to collectively form an annular wall thereinbetween, said primary cylindrical surface having a plate sprocket positioned thereon and abutted against and fixedly attached to said annular wall and a first elongate bore extending lengthwise therethrough for accepting therein a portion of an output shaft of an electric motor mounted externally to said chassis, said secondary cylindrical surface having a second elongate bore extending lengthwise therethrough for accepting therein an axle, said second elongate bore being configured to align with an aperture extending through a mount plate used in mounting said third drive assembly to said back mount plate;

means for coupling together said first, second, and third drive assemblies; and means for operating and controlling said electric motor to drive in unison said first, second, and third drive assemblies to perform the selective functions of lifting, stopping, and lowering the v-shaped platform.

2. An assembly as set forth in claim 1, wherein said coupling means comprises a drive chain simultaneously fitted onto said first plate sprocket of first drive assembly and said secondary plate sprocket of second drive assembly and a motor drive chain simultaneously fitted onto said primary plate sprocket of second drive assembly and said plate sprocket of third drive assembly.

3. An assembly as set forth in claim 1, wherein said electric motor is nominally rated to operate at 110/220 volts.

4. An assembly as set forth in claim 3, wherein said operating and controlling means comprises an electrical circuit operable at 110/220 volts and coupled to said 110/

220-volt electric motor, said electrical circuit comprising a power supply sub-circuit coupled to an outside power source for feeding power to a brake effects delay sub-circuit capable of delaying the transmission of power to said 10/220-volt electric motor to permit selective release of braking features thereof while sustaining a predetermined load and means for switchably controlling said 10/220-volt electric motor in directional modes of forward, stop, and reverse.

5. An assembly as set forth in claim 4, wherein said brake effects delay sub-circuit further comprises a time delayed sub-circuit electrically configured with a zener diode, a capacitor, and a resistor collectively coupled together to operate in delaying the transmission of power to said 110/220-volt electric motor by a time factor of 500 milliseconds.

6. An assembly as set forth in claim 4, wherein said switchably controlling means comprises a three-positionable switch locally operable at said 110/220-volt electric motor and having position indicators designated as up, stop, and down to correspond with and activate said 110/220-volt electric motor's directional modes of forward, braking, and reverse, respectively.

7. An assembly as set forth in claim 4, wherein said switchably controlling means comprises a remote control sub-circuit for distant operation of said 110/220-volt electric motor via a hand-held transmitter selectively operable at a predetermined frequency to correspond with that of a two channel remote control unit.

8. An assembly as set forth in claim 7, wherein said remote control sub-circuit further comprises a transformer coupled in between said power supply sub-circuit and said two channel remote control unit to step down the transmission of power to said remote control sub-circuit from 110/220 VAC to 24 VAC.

9. An assembly as set forth in claim 7, wherein said remote control sub-circuit further comprises a three-positionable toggle switch locally operable at said 10/220-volt electric motor and having position indicators designated as up, stop, and down and a relay set comprising three dedicated relays specifically designated to operate said 110/220-volt electric motor in directional modes of forward, braking, and reverse, respectively.

10. An assembly as set forth in claim 9, wherein said forward relay is coupled to a normally closed proximity switch operably activated in an open state to disconnect the transmission of power into said forward relay as said normally closed proximity switch passes a magnet mounted on a portion of the boat lift structure.

11. An assembly as set forth in claim 1, wherein said chassis comprises top and bottom sides to further protect each of said drive assemblies from inclement climatic conditions, said bottom side having an opening therethrough to permit passage of said cabling.

12. An assembly as set forth in claim 1, wherein said first plate sprocket of first drive assembly comprises a 47-tooth configuration while said primary and secondary plate sprockets of second drive assembly comprise a 40-tooth configuration and a 10-tooth configuration, respectively.

13. An assembly as set forth in claim 12, where said plate sprocket of third drive assembly comprises a 12-tooth configuration.

14. An assembly as set forth in claim 1, wherein one end of said cabling is fitted into an offset bore traversing said cabling barrel and held tighteningly therewithin by a set screw threadably placed within a threaded bore extending perpendicular to said offset bore.

15. An assembly as set forth in claim 1, wherein said first and second ends of cable shaft and said first and second ends of intermediate axle are equipped with an annular groove to accept therein a retaining clip to maintain lateral positioning of said cable shaft and said intermediate axle while being housed within said chassis and a press-fitted flange bearing positioned inwardly from said annular groove and said retaining clip to maintain unhindered rotation and concentricity of said cable shaft and said intermediate axle while each is partially housed within said axial bore and said inner bore, respectively.

16. An assembly as set forth in claim 15, wherein said press-fitted flange bearing comprises primary and secondary outer surfaces, said primary outer surface having a larger diameter than said secondary outer surface and said axial bore and said inner bore to permit positioning thereof outside the ends of said cable hub and stepped hub and establish a predetermined amount of clearance in between the ends of said cable hub and stepped hub and said front access and back mount plates while said first and second drive assemblies reside and operate within said chassis.

17. An assembly as set forth in claim 1, wherein said first elongate bore comprises a keyway extending longitudinally thereabout to accept an equally configured key extending along and perpendicularly outward from said output shaft of electric motor.

18. An assembly as set forth in claim 1, wherein said primary cylindrical surface comprises a pair of threaded apertures extending perpendicularly therethrough for receiving an equal number of set screws to lock said output shaft to said motor hub and maintain positioning thereof within said first elongate bore during rotational movement.

19. An assembly as set forth in claim 1, wherein said secondary cylindrical surface comprises an aperture extending inwardly into said second elongate bore and being selectively positioned in alignment with a cylindrical cavity extending inwardly into said axle for receiving therethrough and resting therein an expansion pin to lock said axle to said motor hub.

20. An assembly as set forth in claim 19, wherein said axle comprises a hex-shaped head at one end thereof to permit turning of said third drive assembly without the activation and assistance of said electric motor.

21. An assembly as set forth in claim 1, wherein said electric motor is housed within a motor cover having a pair of elongate flanges collectively configured for mounting to said front access plate to protect said electric motor and said operating and controlling means from inclement climatic conditions.

22. An assembly as set forth in claim 1, wherein said electric motor is nominally rated to operate at 12/24 volts.

23. An assembly as set forth in claim 22, wherein said operating and controlling means comprises an electrical circuit operable at 12/24 volts and coupled to said 12/24-volt electric motor, said electrical circuit comprising a 12 VDC power supply for feeding power to a brake effects delay sub-circuit capable of delaying the transmission of power to said electric motor to permit selective release of braking features thereof while sustaining a predetermined load and means for switchably controlling said 12/24-volt electric motor in directional modes of forward, stop, and reverse.

24. An assembly as set forth in claim 23, wherein said brake effects delay sub-circuit further comprises a time delayed sub-circuit electrically configured with a zener diode, a capacitor, a resistor, and a reed relay collectively coupled together to operate in delaying the transmission of power to said 12/24-volt electric motor by a time factor of 464 milliseconds.

25. An assembly as set forth in claim 23, wherein said switchably controlling means comprises a three-positionable switch locally operable at said 12/24-volt electric motor and having position indicators designated as up, stop, and down to correspond with and activate said 12/24-volt electric motor's directional modes of forward, braking, and reverse, respectively.

26. An assembly as set forth in claim 23, wherein said switchably controlling means comprises a remote control sub-circuit for distant operation of said 12/24-volt electric motor via a hand-held transmitter selectively operable at a predetermined frequency to correspond with that of a two channel remote control unit.

27. An assembly as set forth in claim 26, wherein said remote control sub-circuit further comprises a three-positionable toggle switch locally operable at said 12/24-volt electric motor and having position indicators designated as up, stop, and down and a relay set comprising three dedicated relays specifically designated to operate said 12/24-volt electric motor in directional modes of forward, braking, and reverse, respectively.

28. An assembly as set forth in claim 27, wherein said forward relay is coupled to a normally closed proximity switch operably activated in an open state to disconnect the transmission of power into said forward relay as said normally closed proximity switch passes a magnet mounted on a portion of the boat lift structure.

29. A winch assembly for automated lifting and lowering of a v-shaped platform of a boat lift structure, said assembly comprising in combination:

a chassis having back mount and front access plates and top and bottom sides collectively arranged to mount and house therein first, second, and third drive assemblies, said first drive assembly comprising a 47-tooth plate sprocket mounted to a spool assembly for concurrent operation therewith, said spool assembly comprising a cable hub having a pair of outwardly extending supports and a cabling barrel positioned thereinbetween and of larger diameter than said extending supports to collectively form adjoining surface area for attaching a pair of cable guards thereagainst to maintain localized positioning of a predetermined amount of cabling wound onto said cabling barrel, said cable hub having an axial bore extending lengthwise thereof for receiving therethrough and housing therein a cable shaft having first and second ends engaging said back mount and front access plates, respectively, said cabling having one end fitted into an offset bore traversing said cabling barrel and held tighteningly therewithin by a set screw threadably placed within a threaded bore extending perpendicular to said offset bore and a second end passing through an opening extending through said bottom side and fixedly attached to a portion of the v-shaped platform, said second drive assembly comprising a stepped hub of integral construction having three discrete cylindrical surfaces each of a predetermined diameter to form first and second annular walls and an inner bore extending lengthwise therethrough for accepting therein an intermediate axle, said first cylindrical surface having a 40-tooth plate sprocket positioned thereon and abutted against and fixedly attached to said first annular wall, said third cylindrical surface having a 10-tooth plate sprocket positioned thereon and abutted against and fixedly attached to said second annular wall, said intermediate axle having first and second ends engaging said front access and back mount plates, respectively, said third drive assembly comprising a motor hub having primary and secondary cylindrical surfaces each of a differing diameter to collectively form an annular wall thereinbetween, said primary cylindrical surface having a 12-tooth plate sprocket positioned thereon and abutted against and fixedly attached to said annular wall and a first elongate bore extending lengthwise therethrough for accepting therein a portion of an output shaft of a 110/220-volt electric motor mounted externally to said chassis, said secondary cylindrical surface having a second elongate bore extending lengthwise therethrough for accepting therein an axle, said second elongate bore being configured to align with an aperture extending through a mount plate used in mounting said third drive assembly to said back mount plate, said primary cylindrical surface comprising a pair of threaded apertures extending perpendicularly therethrough for receiving an equal number of set screws to lock said output shaft to said motor hub and maintain positioning thereof within said first elongate bore during rotational movement, said secondary cylindrical surface comprising an aperture extending inwardly into said second elongate bore and being selectively positioned in alignment with a cylindrical cavity extending inwardly into said axle for receiving therethrough and resting therein an expansion pin to lock said axle to said motor hub;

a drive chain simultaneously fitted onto said first plate sprocket of first drive assembly and said secondary plate sprocket of second drive assembly;

a motor drive chain simultaneously fitted onto said primary plate sprocket of second drive assembly and said plate sprocket of third drive assembly; and means for operating and controlling said 110–220-volt electric motor to drive in unison said first, second, and third drive assemblies to perform the selective functions of lifting, stopping, and lowering the v-shaped platform.

30. An assembly as set forth in claim 29, wherein said operating and controlling means comprises an electrical circuit operable at 110/220 volts and coupled to said 110/220-volt electric motor, said electrical circuit comprising a power supply sub-circuit coupled to an outside power source for feeding power to a brake effects delay sub-circuit capable of delaying the transmission of power to said 110/220-volt electric motor to permit selective release of braking features thereof while sustaining a predetermined load and means for switchably controlling said 110/220-volt electric motor in directional modes of forward, stop, and reverse, said brake effects delay sub-circuit comprising a time delayed sub-circuit electrically configured with a zener diode, a capacitor, and a resistor collectively coupled together to operate in delaying the transmission of power to said 110/220-volt electric motor by a time factor of 500 milliseconds.

31. An assembly as set forth in claim 30, wherein said switchably controlling means comprises a three-positionable switch locally operable at said 110/220-volt electric motor and having position indicators designated as up, stop, and down to correspond with and activate said 110/220-volt electric motor's directional modes of forward, braking, and reverse, respectively.

32. An assembly as set forth in claim 30, wherein said switchably controlling means comprises a remote control sub-circuit for distant operation of said 110/220-volt electric motor via a hand-held transmitter selectively operable at a predetermined frequency to correspond with that of a two channel remote control unit, said remote control sub-circuit comprising a three-positionable toggle switch locally operable at said 110/220-volt electric motor and having position indicators designated a's up, stop, and down and a relay set comprising three dedicated relays specifically designated to operate said 110/220-volt electric motor in directional modes of forward, braking, and reverse, respectively, said forward relay being coupled to a normally closed proximity switch operably activated in an open state to disconnect the transmission of power into said forward relay as said normally closed proximity switch passes a magnet mounted on a portion of the boat lift structure.

33. A winch assembly for automated lifting and lowering of a v-shaped platform of a boat lift structure, said assembly comprising in combination:

a chassis having back mount and front access plates and top and bottom sides collectively arranged to mount and house therein first, second, and third drive assemblies, said first drive assembly comprising a 47-tooth plate sprocket mounted to a spool assembly for concurrent operation therewith, said spool assembly comprising a cable hub having a pair of outwardly extending supports and a cabling barrel positioned thereinbetween and of larger diameter than said extending supports to collectively form adjoining surface area for attaching a pair of cable guards thereagainst to maintain localized positioning of a predetermined amount of cabling wound onto said cabling barrel, said cable hub having an axial bore extending lengthwise thereof for receiving therethrough and housing therein a cable shaft having first and second ends engaging said back mount and front access plates, respectively, said cabling having one end fitted into an offset bore traversing said cabling barrel and held tighteningly therewithin by a set screw threadably placed within a threaded bore extending perpendicular to said offset bore and a second end passing through an opening extending through said bottom side and fixedly attached to a portion of the v-shaped platform, said second drive assembly comprising a stepped hub of integral construction having three discrete cylindrical surfaces each of a predetermined diameter to form first and second annular walls and an inner bore extending lengthwise therethrough for accepting therein an intermediate axle, said first cylindrical surface having a 40-tooth plate sprocket positioned thereon and abutted against and fixedly attached to said first annular wall, said third cylindrical surface having a 10-tooth plate sprocket positioned thereon and abutted against and fixedly attached to said second annular wall, said intermediate axle having first and second ends engaging said front access and back mount plates, respectively, said third drive assembly comprising a motor hub having primary and secondary cylindrical surfaces each of a differing diameter to collectively form an annular wall thereinbetween, said primary cylindrical surface having a 12-tooth plate sprocket positioned thereon and abutted against and fixedly attached to said annular wall and a first elongate bore extending lengthwise therethrough for accepting therein a portion of an output shaft of a 12/24-volt electric motor mounted externally to said chassis, said secondary cylindrical surface having a second elongate bore extending lengthwise therethrough for accepting therein an axle, said second elongate bore being configured to align with an aperture extending through a mount plate used in mounting said third drive assembly to said back mount plate, said primary cylindrical surface comprising a pair of threaded apertures extending perpendicularly therethrough for receiving an equal number of set screws to lock said output shaft to said motor hub and maintain positioning thereof within said first elongate bore during rotational movement, said secondary cylindrical surface comprising an aperture extending inwardly into said second elongate bore and being selectively positioned in alignment with a cylindrical cavity extending inwardly into said axle for receiving therethrough and resting therein an expansion pin to lock said axle to said motor hub;

a drive chain simultaneously fitted onto said first plate sprocket of first drive assembly and said secondary plate sprocket of second drive assembly;

a motor drive chain simultaneously fitted onto said primary plate sprocket of second drive assembly and said plate sprocket of third drive assembly; and means for operating and controlling said 12/24-volt electric motor to drive in unison said first, second, and third drive assemblies to perform the selective functions of lifting, stopping, and lowering the v-shaped platform.

34. An assembly as set forth in claim 33, wherein said plate sprockets of drive assemblies are each configured as straight spur gears and are fabricated from high tensile, high alloy steel material.

35. An assembly as set forth in claim 33, wherein said operating and controlling means comprises an electrical circuit operable at 12/24 volts and coupled to said 12/24-volt electric motor, said electrical circuit comprising a 12 VDC power supply for feeding power to a brake effects delay sub-circuit capable of delaying the transmission of power to said 12/24-volt electric motor to permit selective release of braking features thereof while sustaining a predetermined load and means for switchably controlling said 12/24-volt electric motor in directional modes of forward, stop, and reverse, said brake effects delay sub-circuit comprising a time delayed sub-circuit electrically configured with a zener diode, a capacitor, a resistor, and a reed relay collectively coupled together to operate in delaying the transmission of power to said 12/24-volt electric motor by a time factor of 464 milliseconds.

36. An assembly as set forth in claim 35, wherein said switchably controlling means comprises a three-positionable switch locally operable at said 12/24-volt electric motor and having position indicators designated as up, stop, and down to correspond with and activate said 12/24-volt electric motor's directional modes of forward, braking, and reverse, respectively.

37. An assembly as set forth in claim 35, wherein said switchably controlling means comprises a remote control sub-circuit for distant operation of said 12/24-volt electric motor via a hand-held transmitter selectively operable at a predetermined frequency to correspond with that of a two channel remote control unit, said remote control sub-circuit comprising a three-positionable toggle switch locally operable at said 12/24-volt electric motor and having position indicators designated as up, stop, and down and a relay set comprising three dedicated relays specifically designated to operate said 12/24-volt electric motor in directional modes of forward, braking, and reverse, respectively, said forward relay being coupled to a normally closed proximity switch operably activated in an open state to disconnect the transmission of power into said forward relay as said normally closed proximity switch passes a magnet mounted on a portion of the boat lift structure.

38. An assembly as set forth in claim 35, wherein said 12 VDC power supply is coupled to a solar panel assembly suitably configured to re-generate and replenish power to said power supply over a predetermined amount of time to sustain operation of said 12/24-volt electrical circuit.

* * * * *